US008614043B2

(12) United States Patent
Watanabe et al.

(10) Patent No.: US 8,614,043 B2
(45) Date of Patent: Dec. 24, 2013

(54) TONER

(71) Applicants: Masaki Watanabe, Shizuoka (JP); Osamu Uchinokura, Shizuoka (JP); Junichi Awamura, Shizuoka (JP); Takahiro Honda, Shizuoka (JP); Satoshi Ogawa, Nara (JP); Tsuneyasu Nagatomo, Shizuoka (JP); Hiroshi Yamashita, Shizuoka (JP)

(72) Inventors: Masaki Watanabe, Shizuoka (JP); Osamu Uchinokura, Shizuoka (JP); Junichi Awamura, Shizuoka (JP); Takahiro Honda, Shizuoka (JP); Satoshi Ogawa, Nara (JP); Tsuneyasu Nagatomo, Shizuoka (JP); Hiroshi Yamashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/666,332

(22) Filed: Nov. 1, 2012

(65) Prior Publication Data

US 2013/0130171 A1 May 23, 2013

(30) Foreign Application Priority Data

Nov. 21, 2011 (JP) ..... 2011-253837

(51) Int. Cl.
*G03G 9/087* (2006.01)

(52) U.S. Cl.
USPC ..... 430/110.2; 430/109.3; 430/109.4

(58) Field of Classification Search
USPC ..... 430/110.2, 109.3, 109.4
See application file for complete search history.

(56) References Cited

U.S. PATENT DOCUMENTS

| | | | | |
|---|---|---|---|---|
| 5,223,370 | A * | 6/1993 | Sacripante et al. | 430/109.3 |
| 6,326,117 | B1 * | 12/2001 | Ishihara | 430/110.2 |
| 2009/0155700 | A1 * | 6/2009 | Pang et al. | 430/48 |
| 2009/0325099 | A1 | 12/2009 | Watanabe et al. | |
| 2010/0075245 | A1 | 3/2010 | Watanabe et al. | |
| 2010/0310980 | A1 | 12/2010 | Sugimoto et al. | |
| 2011/0076612 | A1 | 3/2011 | Awamura et al. | |
| 2011/0129773 | A1 | 6/2011 | Shu et al. | |
| 2011/0223532 | A1 | 9/2011 | Sugimoto et al. | |
| 2011/0262856 | A1 | 10/2011 | Sugimoto et al. | |
| 2011/0294058 | A1 | 12/2011 | Shiba et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |
| 2012/0082926 | A1 | 4/2012 | Suzuki et al. | |
| 2012/0189951 | A1 | 7/2012 | Sugimoto et al. | |
| 2012/0219896 | A1 | 8/2012 | Asahina et al. | |
| 2012/0237870 | A1 | 9/2012 | Watanabe et al. | |

FOREIGN PATENT DOCUMENTS

| | | |
|---|---|---|
| JP | 63-109447 | 5/1988 |
| JP | 2-157765 | 6/1990 |

(Continued)

*Primary Examiner* — Hoa V Le

(74) *Attorney, Agent, or Firm* — Oblon, Spivak, McClelland, Maier & Neustadt, L.L.P.

(57) ABSTRACT

A toner including a core particle, an inner shell layer covering the core, and an outer shell layer covering the inner shell layer is provided. The core particle includes a resin P. The inner shell layer includes fine particles of a resin A. The outer shell layer includes fine particles of a resin B. The toner satisfies the following formulae (1) to (3):

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

wherein T½(P), T½(A), and T½(B) represent ½ method temperatures of the resins P, A, and B, respectively, and Tfb(P), Tfb(A), and Tfb(B) represent flow beginning temperatures of the resins P, A, and B, respectively, and wherein the ½ method temperatures and the flow beginning temperatures are measured by a flowtester.

23 Claims, 6 Drawing Sheets

(56) References Cited

FOREIGN PATENT DOCUMENTS

| | | |
|---|---|---|
| JP | 5-297631 | 11/1993 |
| JP | 8-054750 | 2/1996 |
| JP | 11-133665 | 5/1999 |
| JP | 11-249339 | 9/1999 |
| JP | 2001-158819 | 6/2001 |
| JP | 2001-222138 | 8/2001 |
| JP | 2001-242663 | 9/2001 |
| JP | 2002-287400 | 10/2002 |
| JP | 2002-351143 | 12/2002 |
| JP | 2003-302791 | 10/2003 |
| JP | 2004-046095 | 2/2004 |
| JP | 2005-077776 | 3/2005 |
| JP | 2005-156586 | 6/2005 |
| JP | 2005-266012 | 9/2005 |
| JP | 2005-338814 | 12/2005 |
| JP | 2006-267231 | 10/2006 |
| JP | 2007-093809 | 4/2007 |
| JP | 2007-271789 | 10/2007 |
| JP | 2009-109824 | 5/2009 |
| JP | 2009-156902 | 7/2009 |
| JP | 2010-061071 | 3/2010 |
| JP | 2011-107366 | 6/2011 |

* cited by examiner

TONER

CROSS-REFERENCE TO RELATED APPLICATIONS

This patent application is based on and claims priority pursuant to 35 U.S.C. §119 to Japanese Patent Application No. 2011-253837, filed on Nov. 21, 2011 in the Japanese Patent Office, the entire disclosure of which is hereby incorporated herein by reference.

BACKGROUND OF THE INVENTION

1. Technical Field

The present disclosure relates to a toner.

2. Description of Related Art

Recently, copiers are required to be more compact and to mass-produce high-quality images at higher speeds. Currently, high-speed copiers are not always compact because they usually contain a space for collecting residual toner particles.

The collected toner particles are recycled for image formation without being discarded. Recycle of toner particles contributes to not only environmental conservation but also reduction of printing cost.

Recycle of toner particles sometimes causes image deterioration for various reasons.

In attempting to solve the above problem, JP-H02-157765-A describes a toner having a specific particle size distribution. JP-2896826-B (corresponding to JP-H05-297631-A) also describes a toner having a specific particle size distribution.

In electrophotography, an image that is permanently visible is generally formed by fixing toner onto an image support by application of heat. In a case in which a full-color toner image is formed on a transparent sheet as the image support to be projected by an overhead projector ("OHP"), the full-color toner image is required to have a smooth surface to prevent the occurrence of scattering or diffuse reflecting of light at the surface.

For the above reason, full-color toner is generally designed so as to more rapidly transit to a melting state at the melting point, in other words, to express lower viscoelasticity at the melting point, compared to black-and-white toner. The surface of such a full-color toner image can be easily smoothened by application of heat and pressure.

Lowering of viscoelasticity of toner is generally accompanied by lowering of glass transition temperature of the toner, which causes deterioration of mechanical strength of the toner. As a result, developability and transferability of the toner deteriorates because external additives present on the surface of the toner are undesirably embedded in the surface of the toner as the toner is exposed to mechanical stress by being agitated in a developing device. Also, such deteriorated toner particles may undesirably adhere to carrier particles in a two-component developer. These problems are more likely to occur as the particle size of the toner gets much smaller. This is because smaller toner particles are more sensitive to mechanical stress.

In attempting to solve the above problem, JP-3885241-B (corresponding to JP-H08-54750-A) proposes a toner having specific volume average particle diameter (Dv) and storage stability (G').

JP-2001-222138-A proposes a toner binder including a crystalline polyester.

JP-H11-249339-A and JP-2003-302791-A each propose a toner binder including a styrene-acrylic resin and a crystalline polyester consisting primarily of sebacic acid or adipic acid.

JP-2005-338814-A proposes a toner binder including a crystalline polyester having a unit represented by the formula —OCOC—R—COO—(CH2)n- (R represents a C2-C20 straight-chain unsaturated aliphatic group and n represents an integer of 2 to 20) in an amount 60% by mole based on total amount of ester bonds.

SUMMARY

In accordance with some embodiments, a toner including a core particle, an inner shell layer covering the core, and an outer shell layer covering the inner shell layer is provided. The core particle includes a resin P. The inner shell layer includes fine particles of a resin A. The outer shell layer includes fine particles of a resin B. The toner satisfies the following formulae (1) to (3):

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

wherein T½(P), T½(A), and T½(B) represent ½ method temperatures of the resins P, A, and B, respectively, and Tfb(P), Tfb(A), and Tfb(B) represent flow beginning temperatures of the resins P, A, and B, respectively, and wherein the ½ method temperatures and the flow beginning temperatures are measured by a flowtester while setting a load to 30 kg, a die diameter to 1.0 mm, a die length to 1.0 mm, a heating rate to 3° C./min, and a sample amount to 1.0 g.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
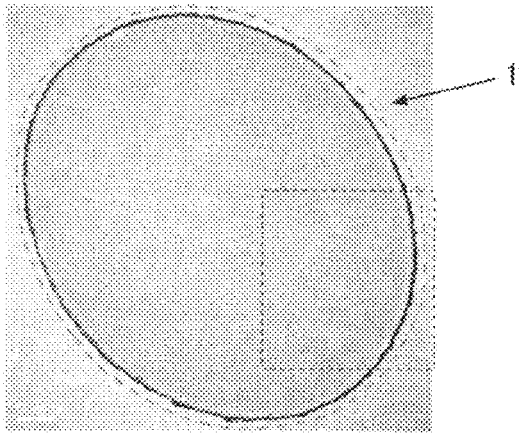
FIGS. 1A to 1C are photographs of a cross-section of a toner according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

According to an embodiment, a toner including a core, an inner shell layer covering the core, and an outer shell layer covering the inner shell layer is provided. The core includes a resin P. The inner shell layer includes fine particles of a resin A. The outer shell layer includes fine particles of a resin B. The toner satisfies the following formulae (1) to (3).

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

T½(P), T½(A), and T½(B) represent ½ method temperatures of the resins P, A, and B, respectively, and Tfb(P), Tfb(A), and Tfb(B) represent flow beginning temperatures of the resins P, A, and B, respectively. The ½ method temperatures and the flow beginning temperatures are measured by a flowtester while setting a load to 30 kg, a die diameter to 1.0 mm, a die length to 1.0 mm, a heating rate to 3° C./min, and a sample amount to 1.0 g.

In accordance with some embodiments, the resin P is a polyester resin, the resin A is an acrylic resin, and the resin B is a styrene-acrylic resin. In the following descriptions, the resins P, A, and B may be referred to as the polyester resin P, acrylic resin A, and styrene-acrylic resin B, respectively, for the sake of clarity.

In some embodiments, the toner may be produced by dissolving or dispersing toner constituents including at least the polyester resin P or a precursor thereof in an organic solvent to prepare a solution or dispersion of the toner constituents; emulsifying the solution or dispersion of the toner constituents in an aqueous medium containing fine particles of the styrene-acrylic resin B having an average diameter of 5 to 50 nm and being anionic together with an optional anionic surfactant, to prepare an emulsion; removing the organic solvent from the emulsion to form toner particles; dispersing the toner particles in ion-exchange water to prepare a dispersion; and heating and agitating the dispersion. The toner may have a weight average particle diameter of 1 to 6 μm. In the process of preparing the emulsion, fine particles of the acrylic resin A having an average particle diameter of 10 to 500 nm are added to the aqueous medium. Thus, the fine particles of the acrylic resin A are included in the emulsion. The acrylic resin A includes elements of C, H, N, and O. Fine particles of the acrylic resin A may be added to the aqueous medium 1) either before or after fine particles of the anionic styrene-acrylic resin B and an optional anionic surfactant are added to the aqueous medium, 2) after the solution or dispersion of the toner constituents is added to the aqueous medium, 3) while an emulsification is occurring by agitating the aqueous medium, or 4) after termination of the emulsification.

Figure 1B:
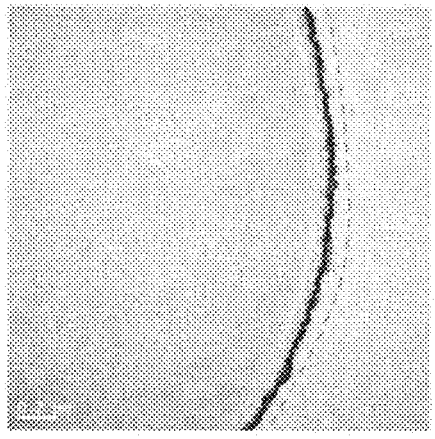
Figure 1C:
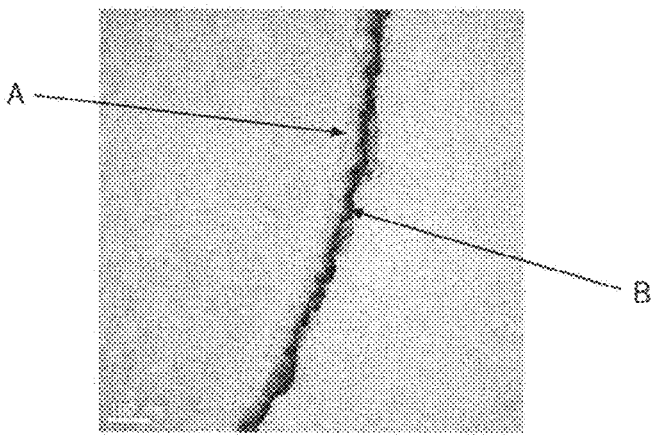

FIG. 1A is a photograph of a cross-section of a toner 1 prepared as above. FIG. 1B is a partial magnified view of FIG. 1A. FIG. 1C is a partial magnified view of FIG. 1B. As shown in FIG. 1C, fine particles of the acrylic resin A and styrene-acrylic resin B are forming inner and outer shell layers, respectively, at the surface of the toner 1. Because fine particles of the styrene-acrylic resin B are small, some of them are embedded in the core particle or fixed at between the core particle and fine particles of the acrylic resin A. The average particle diameter of the toner is controlled by varying the emulsification conditions, such as a condition for agitating the aqueous medium. The order of acid value from highest to lowest may be: styrene-acrylic resin B>polyester resin P>acrylic resin A.

With respect to each of the polyester resin P, acrylic resin A, and styrene-acrylic resin B, the difference between ½ method temperature and flow beginning temperature are within the specified range defined in the formulae (1) to (3). When the difference falls below the specified range, heat-resistant storage stability of the toner may deteriorate or shell layers may not be reliably formed. When the difference exceeds the specified range, the toner may not express low-temperature fixability.

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

T½(P), T½(A), and T½(B) represent ½ method temperatures of the polyester resin P, acrylic resin A, and styrene-acrylic resin B, respectively, and Tfb(P), Tfb(A), and Tfb(B) represent flow beginning temperatures of the polyester resin P, acrylic resin A, and styrene-acrylic resin B, respectively. The ½ method temperatures and the flow beginning temperatures are measured by a flowtester while setting a load to 30 kg, a die diameter to 1.0 mm, a die length to 1.0 mm, a heating rate to 3° C./min, and a sample amount to 1.0 g.

Generally, when relatively small toner particles are used in an electrophotographic image forming apparatus, the toner particles are attracted to a photoreceptor or intermediate transfer medium by a relatively large non-electrostatic adhesive force. Therefore, transfer efficiency deteriorates. Additionally, when relatively small toner particles are used in such an electrophotographic image forming apparatus at a high printing speed, the toner particles are exposed to a transfer electric field, in particular the secondary transfer electric field, for a relatively short time. Therefore, secondary transfer efficiency significantly deteriorates. On the other hand, in accordance with some embodiments, when relatively small toner particles which are covered with a layer of fine particles of the acrylic resin A are used, transfer efficiency does not deteriorate even when the toner particles are exposed to the transfer electric field for only a short time. This is because non-electrostatic adhesive force of such toner particles is relatively small since the fine particles of the acrylic resin A are relatively large and hard. Because of being large and hard, the fine particles of the acrylic resin A are not embedded in the core particle even when the toner is exposed to large mechanical stress. Thus, the toner according to an embodiment can provide high transfer efficiency for an extended period of time. For the same reason, external additives adhered to the surface of the toner are also prevented from being embedded in the core particle.

Fine particles of the acrylic resin A are added to the aqueous medium either before or after the emulsification. Since liquid droplets of the toner constituents contain the organic solvent, in either case, the fine particles of the acrylic resin A are adhered to the surfaces of the liquid droplets while slightly being embedded therein. The fine particles of the acrylic resin A are finally fixed on the core particle of the toner upon removal of the organic solvent. The zeta potential difference between the acrylic resin A and the polyester resin P may be greater than that between the styrene-acrylic resin B and the polyester resin P. This makes fine particles of the styrene-acrylic resin B form an outer shell layer covering an inner shell layer formed of fine particles of the acrylic resin A. Under normal conditions, the styrene-acrylic resin B is more likely to adhere to the surfaces of liquid droplets of the toner constituents because of having greater lipophilicity due to the presence of styrene units and smaller particle diameter than the acrylic resin A.

Fine particles of the anionic styrene-acrylic resin B melt and coalesce with each other on the surface of the core particle to form a relatively hard surface layer. Thus, the layer of the styrene-acrylic resin B prevents the fine particles of the acrylic resin A from being embedded in the core particle even when the toner is exposed to mechanical stress. Because of being anionic, fine particles of the styrene-acrylic resin B adsorb to liquid droplets of the toner constituents while preventing the liquid droplets from coalescing with each other. As a result, the resulting toner particles have a narrow particle diameter distribution. Additionally, the resulting toner particles are given negative charge. In some embodiments, the average particle diameter of the fine particles of the anionic styrene-acrylic resin B is 5 to 50 nm, which is smaller than that of the fine particles of the acrylic resin A.

In some embodiments, the toner has a weight average particle diameter of 1 to 6 μm. In some embodiments, the toner has a weight average particle diameter of 2 to 5 μm. When the weight average particle diameter is less than 1 μm, the toner particles are likely to scatter in the primary and secondary transfer processes. When the weight average particle diameter exceeds 6 μm, dot reproducibility and halftone granularity of the toner is poor and high-definition image is not produced.

In some embodiments, the primary average particle diameter of the fine particles of the acrylic resin A is 10 to 500 nm or 100 to 400 nm, which is relatively large. In such embodiments, non-electrostatic adhesive force of the toner is reduced due to spacer effect. Additionally, the non-electrostatic adhesive force is not further increased because the fine particles are not embedded in the core particle even when the toner is exposed to mechanical stress. Therefore, the toner can provide high transfer efficiency for an extended period of time. Such a toner can be effectively used for an image forming process employing an intermediate transfer process including primary and secondary transfer processes. In particular, the toner can be effectively used for an image forming process in which the transfer linear speed is from 300 to 1,000 mm/sec and the secondary transfer time period is 0.5 to 20 msec.

When the primary average particle diameter of the acrylic resin A is less than 10 nm, non-electrostatic adhesive force of the toner cannot be reduced because spacer effect is insufficient. The fine particles of the acrylic resin A and external additives may be easily embedded in the core particle when the toner is exposed to mechanical stress. Thus, high transfer efficiency cannot be provided for an extended period of time. When the primary average particle diameter of the acrylic resin A exceeds 500 nm, the toner cannot be uniformly transferred due to its low fluidity.

Generally, it is likely that resin particles present on the surfaces of toner particles are embedded therein or get into concave portions thereon when the toner particles are exposed to mechanical stress in a developing device. As a result, the resin particles cannot express their function of reducing adhesive force of the toner particles. Similarly, it is likely that external additives present on the surfaces of toner particles are embedded therein when the toner particles are exposed to mechanical stress. As a result, adhesive force of the toner particles is increased.

According to an embodiment, the fine particles of the acrylic resin A are not likely to be embedded in the toner because of their large size. In some embodiments, the acrylic resin A is a cross-linked resin including an acrylate polymer or a methacrylate polymer. Because the cross-linked resin is relatively hard, fine particles of the cross-linked acrylic resin A is not deformed even when exposed to mechanical stress. Thus, such fine particles can provide good spacer effect while preventing external additives from being embedded in the toner particles.

In some embodiments, the resin P is a polyester resin. When the resin P is a polyester resin and the resin A is a cross-linked acrylic resin including an acrylate polymer or methacrylate polymer, they are poorly compatible with each other. In a case in which fine particles of the acrylic resin A are added to the aqueous medium before or after the emulsification, the fine particles of the acrylic resin A may adhere to and then dissolve in liquid droplets of the toner constituents because the liquid droplets contain the organic solvent. However, when the resin P is a polyester resin and the resin A is a cross-linked acrylic resin including an acrylate polymer or methacrylate polymer, the fine particles of the acrylic resin A only adhere to the liquid droplets without dissolving therein, because the acrylic resin A and the polyester resin P are poorly compatible with each other. The fine particles of the acrylic resin A are adhered to the surfaces of the liquid droplets while being slightly embedded therein and fixed thereon upon removal of the organic solvent. Whether two resins are compatible with each other or not can be determined as follows. Dissolve 50% by weight of each resin in an organic solvent. Mix the resulting two resin solutions. When the mixture solution is observed to be separated into two layers, the two resins are regarded as being incompatible. When the mixture solution is observed not to be separated into two layers, the two resins are regarded as being compatible.

In some embodiments, fine particles of the acrylic resin A are capable of aggregating in an aqueous medium containing an anionic surfactant. In such embodiments, each of the fine particles of the acrylic resin A is prevented from being stably and independently dispersed in the aqueous medium without being adhered to liquid droplets of the toner constituents, when the fine particles are added before or after the process of emulsification. When the fine particles of the acrylic resin A are capable of aggregating in an aqueous medium containing an anionic surfactant, they are easily adhered to liquid droplets of the toner constituents during or after the process of emulsification. Under normal conditions, the fine particles of the acrylic resin A are unstably dispersed in the aqueous medium containing an anionic surfactant and they are likely to self-aggregate. By contrast, in the above embodiments, the fine particles of the acrylic resin A are attracted to the liquid droplets of the toner constituents with a large attractive force. Specific examples of usable anionic surfactants include, but are not limited to, fatty acid salts, alkyl sulfates, alkyl aryl sulfonates, alkyl diaryl ether disulfonates, dialkyl sulfosuccinates, alkyl phosphates, naphthalenesulfonic acid formalin condensates, polyoxyethylene alkyl phosphates, and glyceryl borate fatty acid esters.

After the emulsification, the fine particles of the acrylic resin A may be more strongly fixed on the surfaces of the liquid droplets by being heated to above the glass transition temperature thereof.

In some embodiments, the toner constituents include a compound having an active hydrogen group and a modified polyester resin reactive with the compound, both as precursors of the resin P. In such embodiments, the resulting toner particles have better mechanical strength enough for preventing fine particles of the acrylic resin A or external additives from being embedded in the toner particles. When the compound having an active hydrogen group is cationic, fine particles of the acrylic resin A are electrostatically attracted thereto. Also, it is possible to widen fixable temperature range of the toner because thermal fusibility of the toner is controllable.

In some embodiments, the content of fine particles of the acrylic resin A in the toner is 0.5 to 5% by weight or 1 to 4% by weight based on total weight of the toner. When the content of fine particles of the acrylic resin A is less than 0.5% by weight, non-electrostatic adhesive force of the toner may not be reduced because spacer effect is insufficient. When the content of fine particles of the acrylic resin A exceeds 5% by weight, the toner may not be uniformly transferred due to its poor fluidity. Also, the fine particles may be easily releasable from the toner and therefore contaminate carrier particles and photoreceptor.

In some embodiments, the toner particle has a hardness of 1 to 3 GPa, or 1.2 to 2.6 GPa, when measured by a nano indentation method, and a hardness of 40 to 120 N/mm$^2$, or 60 to 110 N/mm$^2$, when measured by a micro indentation method. The nano indentation method measures a micro hardness of the outermost surface of a toner particle. The micro indentation method measures a macro hardness of the toner particle in whole. The micro hardness determined by the nano indentation method indicates difficulty in embedding fine particles in the surface of a toner particle.

When the micro hardness determined by the nano indentation method falls below 1 GPa, fine particles present on the surface of a toner particle may be embedded therein under mechanical stress. When the micro hardness determined by the nano indentation method exceeds 3 GPa, fine particles present on the surface of a toner particle may not be embedded therein even under mechanical stress, but the surface is too hard to sufficiently melt and to be reliably fixed on a recording medium. When the micro hardness determined by the nano indentation method is within a range of 1 to 3 GPa, it is likely that non-electrostatic adhesive force of a toner particle is reduced even when large-particle-diameter fine particles are not present on the surfaces thereof. A combination of the specific micro hardness and spacer effect of large-particle-diameter fine particles produce a synergistic effect on reduction of non-electrostatic adhesive force of a toner particle. When the hardness determined by the nano indentation method is beyond a range of 1 to 3 GPa, it is likely that non-electrostatic adhesive force of a toner particle is not reduced when large-particle-diameter fine particles are not present on the surfaces thereof.

The macro hardness determined by the micro indentation method indicates difficulty in melting toner for fixing the toner on a recording medium. When the macro hardness determined by the micro indentation method falls below 40 N/mm$^2$, a toner particle in whole is soft and well fixable. However, the toner particle is likely to deform under agitation at a developing part or pressure in a transfer part, resulting in deterioration of image quality. When the toner particle includes a release agent, such as a wax, it is likely that the release agent deposit on carrier particles or photoreceptor. When the macro hardness determined by the micro indentation method exceeds 120 N/mm$^2$, a toner particle in whole is so hard that fine particles present on the surface of the toner particle are not embedded therein even under mechanical stress. However, the surface is too hard to sufficiently melt and to be reliably fixed on a recording medium.

When both the micro and macro hardnesses determined by the nano and micro indentation methods are within the above-described ranges, fine particles (i.e., the acrylic resin A, external additives) present on the surface of the toner particle are not embedded therein while the toner particle is well fixable on a recording medium. To achieve this, the toner particle is given a functionally-separated structure in which the outermost surface has a spacer comprising fine particles of the acrylic resin A and the core particle is designed to be relatively soft.

In some embodiments, the toner has an average circularity of 0.950 to 0.975. When the average circularity is less than 0.950, the toner may not uniformly develop latent images or not be uniformly transferred from an electrophotographic photoreceptor onto an intermediate transfer medium, or from an intermediate transfer medium onto a recording medium.

In some embodiments, the ratio (Dw/Dn) of the weight average particle diameter (Dw) to the number average particle diameter (Dn) of the toner is 1.30 or less. When Dw/Dn exceeds 1.30, it may be difficult to produce high-resolution and high-quality images. Moreover, the average particle diameter of such toner particles in a developer may considerably vary upon consumption and supply of the toner particles.

When Dw/Dn is 1.30 or less, the toner has a good combination of storage stability, low-temperature fixability, hot offset resistance, and gloss property. When such a toner is used for a two-component developer, the average toner size may not vary very much although consumption and supply of toner particles are repeated. When such a toner is used for a one-component developer, the average toner size may not vary very much although consumption and supply of toner particles are repeated. Additionally, the toner may not adhere or fix to a developing roller or a toner layer regulating blade. Thus, stable developability is provided for an extended period of time.

In some embodiments, the toner has a BET specific surface area of 0.5 to 4.0 m$^2$/g or 0.5 to 2.0 m$^2$/g. When the BET specific surface area is less than 0.5 m$^2$/g, it means that fine particles of the styrene-acrylic resin B are covering the surface of the core particle so densely that the resin P in the core particle is prevented from adhering to a recording medium when the toner is to be fixed thereon, resulting in deterioration of low-temperature fixability of the toner. Additionally, the fine particles of the styrene-acrylic resin B inhibit exuding of a release agent from the core particle, resulting in deterioration of offset resistance. When the BET specific surface area is greater than 4.0 m$^2$/g, it means that the fine particles of the styrene-acrylic resin B are coarsely stacked on the surface of the core particle partially forming projecting parts. Thus, the resin P in the core particle is prevented from adhering to a recording medium when the toner is to be fixed thereon, resulting in deterioration of low-temperature fixability of the toner. Additionally, the fine particles of the styrene-acrylic resin B inhibit exuding of a release agent from the core particle, resulting in deterioration of offset resistance. Moreover, external additive particles easily release from the toner and adversely affect the resulting image quality.

The toner according to an embodiment may be used for a two-component developer in combination with a carrier. In some embodiments, the carrier has a weight average particle diameter of 15 to 40 μm. When the weight average particle diameter is less than 15 μm, it is likely that the carrier particles are transferred onto a recording medium together with toner particles and deposited on the resulting image. When the weight average particle diameter is greater than 40 μm, it is likely that background portions of the resulting image are soiled with toner particles when the toner concentration is high. Additionally, granularity in highlight portions may deteriorate when the dot size of a latent image is relatively small.

An image forming method according to an embodiment includes: a charging process in which a charger charges an electrophotographic photoreceptor; an irradiation process in which an irradiator irradiates the charged electrophotographic photoreceptor to form an electrostatic latent image thereon; a developing process in which a developing device develops the electrostatic latent image into a toner image with the toner according to an embodiment; a primary transfer process in which a primary transfer device primarily transfers the toner image from the electrophotographic photoreceptor onto an intermediate transfer member; a secondary transfer process in which a secondary transfer device secondarily transfers the toner image from the intermediate transfer member onto a recording medium; a fixing process in which a fixing device fixes the toner image on the recording medium by application of heat and pressure; and a cleaning process in which a cleaner removes residual toner particles remaining on the intermediate transfer member without being transferred onto the recording medium. In some embodiments, in the secondary transfer process, the toner image is transferred from the intermediate transfer member onto the recording medium at a linear speed of 100 to 1,000 mm/sec within a time period of 0.5 to 60 msec.

An image forming apparatus according to an embodiment includes an electrophotographic photoreceptor, a charger, an irradiator, a developing device, a primary transfer device, a cleaning device, and a fixing device. In some embodiments, the image forming apparatus includes tandemly-disposed multiple sets of an electrophotographic photoreceptor, a charger, an irradiator, a developing device, a primary transfer device, and a cleaning device (hereinafter "tandem image forming apparatus"). The tandem image forming apparatus provides high-speed printing because a toner image of each color is formed on each of the multiple electrophotographic photoreceptors substantially at the same time. The toner images formed on the respective electrophotographic photoreceptors are superimposed on one another to form a full-color toner image.

Since the toner according to an embodiment provides reliable developability and adhesive force regardless of its color, each of the toner images uniformly adheres to the electrophotographic photoreceptor and recording medium, providing a full-color toner image having a high color reproducibility.

In some embodiments, the charger is configured to apply a direct current voltage overlapped with an alternating current voltage. The surface potential of the electrophotographic photoreceptor gets more stable and uniform when the electrophotographic photoreceptor is applied with a direct current voltage overlapped with an alternating current voltage rather than a direct current voltage. In some embodiments, the charger is configured to bring a charging member into contact with the electrophotographic photoreceptor and to apply a voltage to the charging member in contact with the electrophotographic photoreceptor. By applying a direct current overlapped with an alternating current to the charging member in contact with the electrophotographic photoreceptor, the electrophotographic photoreceptor is much more uniformly charged.

In some embodiments, the fixing device includes a heating roller, a fixing roller, a seamless fixing belt, and a pressing roller. The heating roller is comprised of a magnetic metal and is heatable by electromagnetic induction. The fixing roller is disposed in parallel with the heating roller. The fixing belt is stretched across the heating and fixing rollers and is heated by the heating roller and rotated by the heating and fixing rollers. The pressing roller is pressed against the fixing roller with the fixing belt therebetween and is rotatable in a forward direction relative to the fixing belt. In these embodiments, it is possible to heat the fixing belt within a short time period and to reliably control temperature. The fixing belt is capable of reliably fixing toner images even on a recording medium having a rough surface.

In some embodiments, the fixing device needs no oil or a slight amount of oil when fixing toner images a recording medium. In these embodiments, a release agent (e.g., a wax) is finely dispersed in the toner. The release agent exudes from the toner when the toner is being fixed on the recording medium. Therefore, the toner is prevented from transferring onto the fixing belt even when the fixing belt is applied with no oil or a slight amount of oil. To be finely dispersed in the toner, the release agent is incompatible with the binder resin of the toner. The release agent can be finely dispersed in the toner by adjusting manufacturing conditions. Dispersing condition of the release agent can be determined by observing a ultrathin section of the toner by a transmission electron microscope (TEM). When the dispersion diameter of the release agent is too small, the release agent may not satisfactorily exude from the toner. When the release agent domains are observable by TEM at a magnification of 10,000, the release agent is regarded to be dispersed in a proper condition. When the release agent domains are not observable by TEM at a magnification of 10,000, the release agent may not exude from the toner satisfactorily.

Weight average particle diameter (Dw), volume average particle diameter (Dv), and number average particle diameter (Dn) of the toner are measured by a particle size analyzer MULTISIZER III (from Beckman Coulter, Inc.) having an aperture size of 100 μm and an analysis software program Beckman Coulter Multisizer 3 Version 3.51 as follows. First, charge a 100-ml glass beaker with 0.5 ml of a 10% surfactant (an alkylbenzene sulfonate NEOGEN SC-A from Dai-ichi Kogyo Seiyaku Co., Ltd.). Add 0.5 g of a sample to the beaker and mix with a micro spatula. Further, add 80 ml of ion-exchange water to the beaker. Subject the resulting dispersion to a dispersion treatment for 10 minutes using an ultrasonic disperser (W-113 MK-II from Honda Electronics). Subject the dispersion to a measurement by the MULTISIZER III using a measuring solution ISOTON III (from Beckman Coulter, Inc.). During the measurement, the amount of the dispersion is controlled so that the sample concentration is within 8±2%. In terms of measurement reproducibility, it is important to keep the sample concentration within 8±2% so as not to cause measurement error.

Average circularity SR is defined by the following formula: $SR(\%)=Cs/Cp\times100$, wherein Cp represents a peripheral length of a projected image of a particle and Cs represents a peripheral length of a circle having the same area as the projected image of the particle. The average circularity of the toner is determined using a flow particle image analyzer FPIA-2100 (from Sysmex Corporation) and an analysis software FPIA-2100 Data Processing Program for FPIA version 00-10 as follows. First, charge a 100-ml glass beaker with 0.1 to 0.5 ml of a 10% surfactant (an alkylbenzene sulfonate NEOGEN SC-A from Dai-ichi Kogyo Seiyaku Co., Ltd.). Add 0.1 to 0.5 g of a sample to the beaker and mix with a micro spatula. Further, add 80 ml of ion-exchange water to the beaker. Subject the resulting dispersion to a dispersion treatment for 3 minutes using an ultrasonic disperser (from Honda Electronics). Measure a shape distribution by FPIA-2100 when the dispersion has a concentration of 5,000 to 15,000 particles per micro-liter. In terms of measurement reproducibility, it is important to measure a shape distribution when the dispersion has a concentration of 5,000 to 15,000 particles per micro-liter. To make the dispersion have the desired concentration, the amount of surfactant or toner included in the dispersion may be varied. When the amount of surfactant in the dispersion is too large, noisy bubbles are undesirably generated. When the amount of surfactant in the dispersion is too small, toner particles cannot sufficiently get wet or dispersed. The proper amount of toner in the dispersion depends on particle diameter of toner. The smaller the particle diameter of toner, the smaller the proper amount of the toner. When a toner has a particle diameter of 3 to 7 μm, 0.1 to 0.5 g of the toner should be included in the dispersion so that the dispersion has a concentration of 5,000 to 15,000 particles per micro-liter.

BET specific surface area of toner is measured by a micromeritics automatic surface area and porosimetry analyzer TriStar 3000 (from Shimadzu Corporation) as follows. Charge a measuring cell with 1 g of a sample. Deaerate the measuring cell by a deaeration unit VacuPrep 601 (from Shimadzu Corporation) for 20 hours at reduced pressures or 100 mtorr or less and at room temperature. Subject the deaerated measuring cell to a measurement of BET specific surface area by the TriStar 3000. Nitrogen gas is used as an adsorption gas.

In the nano indentation method, a hardness of toner is measured by an instrument TriboIndenter® from Hysitron Corporation. The measurement conditions are as follows.

Indenter: Berkovich (trigonal pyramid shape)

Maximum indentation depth: 20 nm

The indenter indents the surface of one toner particle. A hardness H [GPa] of the toner particle is determined from the size of an impression which is made at the maximum indention depth. In the method, 10 randomly-selected portions of 100 toner particles are subjected to the above measurement procedure and the measured values are averaged. Thus, the "hardness measured by the nano indentation method" is determined.

In the micro indentation method, a hardness of toner is measured by an instrument FISCHERSCOPE H100® from Fischer Instruments K.K. The measurement conditions are as follows.

Indenter: Vickers indenter

Maximum indentation depth: 2 μm

Maximum indentation load: 9.8 mN

Creep time: 5 sec

Loading (unloading) time: 30 sec

The Vickers indenter indents the surface of one toner particle to measure the Martens hardness [N/mm$^2$] In the method, 100 toner particles are subjected to the above measurement procedure and the measured values are averaged. Thus, the "hardness measured by the micro indentation method" is determined.

The weight average particle diameter (Dw) of carrier particles is determined based on a particle diameter distribution on number basis (i.e., a relation particle diameter and number frequency) and is represented by the following formula:

$$Dw=\{1/\Sigma(nD^3)\}\times\{\Sigma(nD^4)\}$$

wherein D represents a representative diameter (μm) among particles belonging to each channel and n represents total number of particles belonging to each channel. Here, "channel" represents a unit length equally dividing the particle diameter axis of a particle size distribution chart. In the present embodiment, each channel has a length of 2 μm. In the present embodiment, the minimum particle diameter among particles belonging to each channel is employed as the representative diameter.

The number average particle diameter (Dp) of carrier particles is determined based on a particle diameter distribution on number basis and is represented by the following formula:

$$Dp=(1/\Sigma N)\times(\Sigma nD)$$

wherein N represents total number of particles, n represents total number of particles belonging to each channel, and D represents the minimum particle diameter (μm) among particles belonging to each channel (having a length of 2 μm).

The particle diameter distribution is measured by a particle size analyzer Microtrac HRA9320-X100 from Honeywell. The measurement conditions are as follows.

Particle diameter range: 8 to 100 μm

Channel length (Channel width): 2 μm

Number of channels: 46

Refractive index: 2.42

In accordance with some embodiments, the toner is manufactured as follows.

The toner according to an embodiment includes a core particle comprising toner constituents, an inner shell layer comprising fine particles of an acrylic resin A, covering the core particle, and an outer shell layer comprising fine particles of a styrene-acrylic resin B, covering the inner shell layer. The toner may be produced by dissolving or dispersing the toner constituents in an organic solvent, emulsifying the resulting solution or dispersion of the toner constituents in an aqueous medium containing an anionic surfactant and fine particles of the styrene-acrylic resin B having an average particle diameter of 5 to 50 nm to prepare an emulsion, adding fine particles of the acrylic resin A having an average particle diameter of 10 to 500 nm to the aqueous medium, and removing the organic solvent from the emulsion to form toner particles. After the organic solvent is removed from the emulsion, the emulsion that is containing toner particles is heated at 40 to 60° C. so that the fine particles of the acrylic resin A are fixed to the surface of the toner particles. When the solution or dispersion of the toner constituents is emulsified in the aqueous medium, a dispersant can be used, for the purpose of stabilizing liquid droplets to obtain toner particles with a desired shape and a narrow particle size distribution. The dispersant may be, for example, an anionic surfactant, a poorly-water-soluble inorganic compound, or a polymeric protection colloid. Two or more of these materials can be used in combination. In some embodiments, an anionic surfactant is used.

According to an embodiment, the styrene-acrylic resin B may be, for example, a copolymer of styrene with a (meth) acrylic acid or a (meth)acrylate.

Any styrene-acrylic resin capable of forming an aqueous dispersion thereof may be used. Specific examples of usable styrene-acrylic resins include, but are not limited to, styrene-acrylate copolymer, styrene-methacrylate copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

In some embodiments, the styrene-acrylic resin is anionic. An anionic styrene-acrylic resin may be obtained from a (meth)acrylic acid, not a (meth)acrylate. Anionic styrene-acrylic resin particles do not aggregate when being used in combination with an anionic surfactant. Anionic styrene-acrylic resin particles may be obtained by treating styrene-acrylic resin particles with an anionic activator or introducing an anionic group such as carboxyl group or sulfonic group into styrene-acrylic resin particles. In some embodiments, the styrene-acrylic resin particles have a primary particle diameter of 5 to 50 nm or 10 to 25 nm, which can reliably control particle size and particle size distribution of the emulsified particles. The particle diameter can be measured by scanning electron microscopy, transmission election microscopy, or light scattering methods. For example, volume average particle diameter can be measured by Particle Size Distribution Analyzer LA-9920 (from Horiba, Ltd.).

In some embodiments, the fine particles of the styrene-acrylic resin are obtained in the form of aqueous dispersion. An aqueous dispersion of fine particles of the styrene-acrylic resin can be prepared as follows, for example.

(1) An aqueous dispersion of a vinyl resin is obtainable by directly subjecting raw materials including a vinyl monomer to a suspension polymerization, an emulsion polymerization, a seed polymerization, or a dispersion polymerization.

(2) An aqueous dispersion of a polyaddition or polycondensation resin (e.g., polyester resin, polyurethane resin, epoxy resin) is obtainable by dispersing a precursor (e.g., monomer, oligomer) of the resin or a solution thereof in an aqueous medium in the presence of a dispersant, and curing the precursor by application of heat or addition of a curing agent.

(3) An aqueous dispersion of a polyaddition or polycondensation resin (e.g., polyester resin, polyurethane resin, epoxy resin) is obtainable by dissolving an emulsifier in a precursor (e.g., monomer, oligomer) of the resin or a solution (preferably in a liquid state, or which may be liquefied by application of heat) thereof, and further adding water thereto to cause phase-transfer emulsification.

(4) An aqueous dispersion of a resin produced by a polymerization reaction (e.g., addition polymerization, ring-opening polymerization, polyaddition, addition condensation, polycondensation) is obtainable by pulverizing the resin into particles by a mechanical rotary pulverizer or a jet pulverizer, classifying the particles by size to collect desired-size particles, and dispersing the collected particles in an aqueous medium in the presence of a dispersant.

(5) An aqueous dispersion of a resin produced by a polymerization reaction (e.g., addition polymerization, ring-opening polymerization, polyaddition, addition condensation, polycondensation) is obtainable by dissolving the resin in a solvent, spraying the resulting resin solution to form resin particles, and dispersing the resin particles in an aqueous medium in the presence of a dispersant.

(6) An aqueous dispersion of a resin produced by a polymerization reaction (e.g., addition polymerization, ring-opening polymerization, polyaddition, addition condensation, polycondensation) is obtainable by dissolving the resin in a solvent and further adding a poor solvent to the resulting resin solution, or dissolving the resin in a solvent by application of heat and cooling the resulting resin solution, to precipitate resin particles, removing the solvents to isolate the resin particles, and dispersing the resin particles in an aqueous medium in the presence of a dispersant.

(7) An aqueous dispersion of a resin produced by a polymerization reaction (e.g., addition polymerization, ring-opening polymerization, polyaddition, addition condensation, polycondensation) is obtainable by dissolving the resin in a solvent, dispersing the resulting resin solution in an aqueous medium in the presence of a dispersant, and removing the solvent by application of heat and/or reduction of pressure.

(8) An aqueous dispersion of a resin produced by a polymerization reaction (e.g., addition polymerization, ring-opening polymerization, polyaddition, addition condensation, polycondensation) is obtainable by dissolving the resin in a solvent, dissolving an emulsifier in the resulting resin solution, and adding water thereto to cause phase-transfer emulsification.

In some embodiments, the acrylic resin particles have a primary particle diameter of 10 to 500 nm or 10 to 200 nm, which can reliably control particle size and particle size distribution of the emulsified particles. The particle diameter can be measured by scanning electron microscopy, transmission election microscopy, or light scattering methods. To easily adhere the acrylic resin particles to liquid droplets of the toner constituents, the acrylic resin particles may be given a property of aggregating in the aqueous medium containing an anionic surfactant. To achieve this, a nonionic, ampholytic, or cationic surfactant may be used in the above-described preparation methods or a cationic group may be introduced to the resin.

Usable cationic surfactants include amine-salt-type surfactants and quaternary-ammonium-salt type surfactants. Specific examples of the amine-salt-type surfactants include, but are not limited to, alkyl amine salts, amino alcohol fatty acid derivatives, polyamine fatty acid derivatives, and imidazoline. Specific examples of the quaternary-ammonium-salt type surfactants include, but are not limited to, alkyl trimethyl ammonium salts, dialkyl dimethyl ammonium salts, alkyl dimethyl benzyl ammonium salts, pyridinium salts, alkyl isoquinolinium salts, and benzethonium chloride. In some embodiments, aliphatic primary, secondary, or tertiary amine acids having a fluoroalkyl group, aliphatic quaternary ammonium salts such as perfluoroalkyl (C6-C10) sulfonamide propyl trimethyl ammonium salts, benzalkonium salts, benzethonium chloride, pyridinium salts, and imidazolinium salts.

Specific examples of commercially available such cationic surfactants include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Specific examples of usable nonionic surfactants include, but are not limited to, fatty acid amide derivatives and polyol derivatives.

Specific examples of usable ampholytic surfactants include, but are not limited to, alanine, dodecyldi(aminoethyl)glycine, di(octylaminoethyl)glycine, and N-alkyl-N,N-dimethyl ammonium betaine.

Swelling property of the acrylic resin particles can be controlled by varying cross-linking density or monomer composition.

In some embodiments, the acrylic resin particles may be comprised of a cross-linked polymer so as to be fixed to the surfaces of liquid droplets of the toner constituents without being dissolved therein. Usable cross-linked polymers include, for example, a copolymer of an acrylic monomer with a monomer having at least two unsaturated groups. Specific examples of the monomer having at least two unsaturated groups include, but are not limited to, a sodium salt of sulfate ester of ethylene oxide adduct of methacrylic acid (ELEMINOL RS-30 from Sanyo Chemical Industries, Inc.), divinyl compounds (e.g., divinylbenzene), and diacrylate compounds (e.g., 1,6-hexanediol acrylate).

Owing to swelling property of the acrylic resin particles in organic solvents, the toner particles can provide reliable transfer efficiency and a wide fixable temperature range as well as good cleanability. The toner particles have an irregular shape and a relatively smooth surface, which is represented by an average circularity of about 0.950 to 0.975 and a BET specific surface area of about 0.5 to 4.0 $m^2/g$. When the degree of swelling property is too large, the average circularity of the toner may be too small. When the degree of swelling property is too small, the BET specific surface area of the toner may be too large. When the BET specific surface area falls below 0.5 $m^2/g$, cleanability of the toner may deteriorate. When the BET specific surface area exceeds 4.0 $m^2/g$, stability of the toner may deteriorate.

Specific examples of usable anionic surfactants include, but are not limited to, alkylbenzene sulfonates, α-olefin sulfonates, and phosphates. In some embodiments, anionic surfactants having a fluoroalkyl group are used. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates.

Specific examples of commercially available such anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

In some embodiments, the P resin (hereinafter maybe "binder resin") is a polyester resin.

Polyester resins can produce smooth image surface due to their sharply-melting property. Polyester resins have sufficient flexibility even when the molecular weight is low. In some embodiments, the polyester resin has a ½ method temperature (T½) of 50 to 80° C. When T½ falls below 50° C., storage stability of the toner may deteriorate, i.e., the toner particles may aggregate even at room temperature. When T½ exceeds 80° C., the toner may not sufficiently melt when being fixed on paper, causing an offset problem.

Usable polyester resin is obtained by reacting at least one polyol having the following formula (i) with at least one polycarboxylic acid having the following formula (ii):

$$A\text{-}(OH)_m \quad \text{(i)}$$

wherein A represents an alkyl or alkylene group having 1 to 20 carbon atoms or a substituted or unsubstituted aromatic or heterocyclic aromatic group, and m represents an integer of 2 to 4;

$$B\text{—}(COOH)_n \quad \text{(ii)}$$

wherein B represents an alkyl or alkylene group having 1 to 20 carbon atoms or a substitute or unsubstituted aromatic or heterocyclic aromatic group; and m represents an integer of 2 to 4.

Specific examples of usable polyols having the formula (i) include, but are not limited to, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, and propylene oxide adduct of hydrogenated bisphenol A.

Specific examples of usable carboxylic acids having the formula (ii) include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-hexanetricarboxylic acid, tetra(methylenecarboxyl)methane, 1,2,7,8-octanetetracarboxylic acid, pyromellitic acid, enpol trimmer acid, cyclohexanedicarboxylic acid, cyclohexenedicarboxylic acid, butanetetracarboxylic acid, diphenylsulfone tetracarboxylic acid, and ethylene glycol bis(trimellitic acid).

In some embodiments, the binder resin is a mixture of an unmodified binder resin and a reaction product of a binder resin precursor (i.e., prepolymer). In this case, the acrylic resin A is incompatible with the unmodified binder resin.

When toner constituents include a compound having an active hydrogen group and a polymer reactive with the compound (e.g., a modified polyester resin), the resulting toner particles have better mechanical strength enough for preventing fine particles of the acrylic resin A or external additives from being embedded in the toner particles. When the compound having an active hydrogen group is cationic, fine particles of the acrylic resin A are electrostatically attracted thereto. Also, it is possible to widen fixable temperature range of the toner because thermal fusibility of the toner is controllable. The compound having an active hydrogen group and the polymer reactive with the compound are both precursors of a binder resin.

The compound having an active hydrogen group acts as an elongater or a cross-linker for elongating or cross-linking the polymer reactive with the compound in the aqueous medium. In some embodiments, the polymer reactive with the compound having an active hydrogen group is a polyester prepolymer (A) having an isocyanate group and the compound having an active hydrogen group is an amine (B). This combination can produce a high-molecular-weight polyester through elongating and/or cross-linking reactions.

The active hydrogen group may be, for example, a hydroxyl group (e.g., an alcoholic hydroxyl group, a phenolic hydroxyl group), an amino group, a carboxyl group, a mercapto group, or a combination thereof.

The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked. Two or more of these materials can be used in combination. In some embodiments, a diamine (B1) alone or a mixture of a diamine (B1) with a small amount of a polyamine (B2) having 3 or more valences is used.

Specific examples of the diamine (B1) include, but are not limited to, aromatic diamine, alicyclic diamine, and aliphatic diamine. Specific examples of the aromatic diamine include, but are not limited to, phenylenediamine, diethyltoluenediamine, and 4,4'-diaminodiphenylmethane. Specific examples of the alicyclic diamine include, but are not limited to, 4,4'- diamino-3,3'-dimethyldicyclohexylmethane, diamine cyclohexane, and isophoronediamine. Specific examples of the aliphatic diamine include, but are not limited to, ethylenediamine, tetramethylenediamine, and hexamethylenediamine.

Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

The elongating and/or cross-linking reaction between the compound having an active hydrogen group and the polymer reactive with the compound having an active hydrogen group can be terminated by a reaction terminator to control molecular weight of the resulting resin. Specific examples of usable reaction terminators include, but are not limited to, monoamines (e.g., diethylamine, dibutylamine, butylamine, laurylamine) and blocked monoamines (e.g., ketimine compounds).

In some embodiments, the equivalent ratio [NCO]/[NHx] of isocyanate groups [NCO] in the polyester prepolymer (A) to amino groups [NHx] in the amine (B) is 1/3 to 3/1, 1/2 to 2/1, or 1/1.5 to 1.5/1. When the equivalent ratio [NCO]/[OH] is less than ⅓, low-temperature fixability of the toner may be poor. When the equivalent ratio [NCO]/[OH] is greater than 3/1, hot offset resistance of the toner may be poor because molecular weight of the resulting urea-modified polyester is too small.

The polymer reactive with the compound having an active hydrogen group (hereinafter "prepolymer") may be, for example, a polyol resin, a polyacrylic resin, a polyester resin, an epoxy resin, or a derivative resin thereof. Polyester resins are advantageous in terms of fluidity and transparency when melted. Two or more of these materials can be used in combination.

The prepolymer has a site reactive the compound having an active hydrogen group. The site may be, for example, an isocyanate group, an epoxy group, a carboxyl group, or an acid chloride group. Two or more of these groups can be included in combination. In some embodiments, the prepolymer has an isocyanate group. In some embodiments, the prepolymer is a polyester resin having an urea-bond-forming group (RMPE). By using RMPE, it is easy to control molecular weight of high-molecular-weight components the resulting toner. RMPE can provide a toner having low-temperature fixability even in oilless fixing devices.

In some embodiments, the urea-bond-forming group is an isocyanate group. When the urea-bond-forming group of the polyester resin (PMPE) is an isocyanate group, the polyester resin (PMPE) may be the polyester prepolymer (A) having an isocyanate group. The polyester prepolymer (A) having an isocyanate group may be a reaction product of a polyester having an active hydrogen group, which is a polycondensation product of a polyol (PO) with a polycarboxylic acid (PC), with a polyisocyanate (PIC). Usable polyols (PO) include, for example, diols (DIO), polyols (TO) having 3 or more valences, and mixtures thereof. Two or more of these materials can be used in combination. In some embodiments, a diol (DIO) alone or a mixture of a diol (DIO) with a small amount of a polyol (TO) having 3 or more valences is used.

Specific examples of usable diols (DIO) include, but are not limited to, alkylene glycols, alkylene ether glycols, alicyclic diols, alkylene oxide adducts of alicyclic diols, bisphenols, alkylene oxide adducts of bisphenols.

Specific examples of usable alkylene glycols include, but are not limited to, alkylene glycols having 2 to 12 carbon atoms such as ethylene glycol, 1,2-propylene glycol, 1,3-propylene glycol, 1,4-butanediol, and 1,6-hexanediol. Specific examples of usable alkylene ether glycols include, but are not limited to, diethylene glycol, triethylene glycol, dipropylene glycol, polyethylene glycol, polypropylene glycol, and polytetramethylene ether glycol. Specific examples of usable alicyclic diols include, but are not limited to, 1,4-cyclohexanedimethanol and hydrogenated bisphenol A. Specific examples of usable alkylene oxide adducts of alicyclic diols include, but are not limited to, ethylene oxide adducts, propylene oxide adducts, and butylene oxide adducts of alicyclic diols. Specific examples of usable bisphenols include, but are not limited to, bisphenol A, bisphenol F, and bisphenol S. Specific examples of usable alkylene oxide adducts of bisphenols include, but are not limited to, ethylene oxide adducts, propylene oxide adducts, and butylene oxide adducts of bisphenols. In some embodiments, an alkylene glycol having 2 to 12 carbon atoms or an alkylene oxide adduct of a bisphenol is used. In some embodiments, an alkylene oxide adduct of a bisphenol alone or a mixture of an alkylene oxide adduct of a bisphenol and an alkylene glycol having 2 to 12 carbon atoms is used.

Specific examples of usable polyols (TO) having 3 or more valences include, but are not limited to, polyvalent aliphatic alcohols having 3 or more valences, polyphenols having 3 or more valences, and alkylene oxide adducts of polyphenols having 3 or more valences. Specific examples of usable polyvalent aliphatic alcohols having 3 or more valences include, but are not limited to, glycerin, trimethylolethane, trimethylolpropane, pentaerythritol, and sorbitol. Specific examples of usable polyphenols having 3 or more valences include, but are not limited to, trisphenols (e.g., trisphenol PA from Honshu Chemical Industry Co., Ltd.), phenol novolac, cresol novolac. Specific examples of usable alkylene oxide adducts of polyphenols having 3 or more valences include, but are not limited to, ethylene oxide adducts, propylene oxide adducts, and butylene oxide adducts of polyphenols having 3 or more valences.

In some embodiments, a mixture of 100 parts by weight of a diol (DIO) with 0.01 to 10 parts by weight, or 0.01 to 1 part by weight, of a polyol (TO) having 3 or more valences is used.

Usable polycarboxylic acids (PC) include, for example, dicarboxylic acids (DIC), polycarboxylic acids (TC) having 3 or more valences, and mixtures thereof. Two or more of these materials can be used in combination. In some embodiments, a dicarboxylic acid (DIC) alone or a mixture of a dicarboxylic acid (DIC) with a small amount of a polycarboxylic acid (TC) having 3 or more valences is used.

Specific examples of usable dicarboxylic acids (DIC) include, but are not limited to, alkylene dicarboxylic acids, alkenylene dicarboxylic acids, and aromatic dicarboxylic acids. Specific examples of usable alkylene dicarboxylic acids include, but are not limited to, succinic acid, adipic acid, and sebacic acid. Specific examples of usable alkenylene dicarboxylic acids include, but are not limited to, maleic acid and fumaric acid, which are having 4 to 20 carbon atoms. Specific examples of usable aromatic dicarboxylic acids include, but are not limited to, phthalic acid, isophthalic acid, terephthalic acid, and naphthalenedicarboxylic acid, which are having 8 to 20 carbon atoms. In some embodiments, an alkenylene dicarboxylic acid having 4 to 20 carbon atoms or an aromatic dicarboxylic acid having 8 to 20 carbon atoms is used.

Specific examples of usable polycarboxylic acids (TC) having 3 or more valences include, but are not limited to, aromatic polycarboxylic acids having 9 to 20 carbon atoms (e.g., trimellitic acid, pyromellitic acid).

Usable polycarboxylic acids (PC) further include acid anhydrides and lower alkyl esters of dicarboxylic acids (DIC), polycarboxylic acids (TC) having 3 or more valences, and mixtures thereof. The lower alkyl esters include, for example, methyl ester, ethyl ester, and isopropyl ester.

In some embodiments, a mixture of 100 parts by weight of a dicarboxylic acid (DIC) with 0.01 to 10 parts by weight, or 0.01 to 1 part by weight, of a polycarboxylic acid (TC) having 3 or more valences is used.

In some embodiments, the equivalent ratio [OH]/[COOH] of hydroxyl groups [OH] in the polyol (PO) to carboxyl groups [COOH] in the polycarboxylic acid (PC) is 2/1 to 1/1, 1.5/1 to 1/1, or 1.3/1 to 1.02/1.

In some embodiments, the content of the polyol (PO) in the polyester prepolymer (A) having an isocyanate group is 0.5 to 40% by weight, 1 to 30% by weight, or 2 to 20% by weight. When the content is less than 0.5% by weight, hot offset resistance, heat-resistant storage stability, and low-temperature fixability of the toner may be poor. When the content is greater than 40% by weight, low-temperature fixability of the toner may be poor.

Specific examples of usable polyisocyanates (PIC) include, but are not limited to, aliphatic polyisocyanates, alicyclic polyisocyanates, aromatic diisocyanates, aromatic aliphatic diisocyanates, isocyanurates, and those blocked with a phenol derivative, an oxime, or a caprolactam.

Specific examples of usable aliphatic polyisocyanates include, but are not limited to, tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate. Specific examples of usable alicyclic polyisocyanates include, but are not limited to, isophorone diisocyanate and cyclohexylmethane diisocyanate. Specific examples of usable aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate. Specific examples of usable aromatic aliphatic diisocyanates include, but are not limited to, α,α,α',α'-tetramethylxylylene diisocyanate. Specific examples of usable isocyanurates include, but are not limited to, tris-isocyanatoalkyl isocyanurate and triisocyanatocycloalkyl isocyanurate. Two or more of these materials can be used in combination.

In some embodiments, the equivalent ratio [NCO]/[OH] of isocyanate groups [NCO] in the polyisocyanate (PIC) to hydroxyl groups [OH] in the polyester resin having an active hydrogen group is 5/1 to 1/1, 4/1 to 1.2/1, or 3/1 to 1.5/1. When the equivalent ratio [NCO]/[OH] is greater than 5/1, low-temperature fixability of the toner may be poor. When the equivalent ratio [NCO]/[OH] is less than 1/1, hot offset resistance of the toner may be poor.

In some embodiments, the content of the polyol (PIC) in the polyester prepolymer (A) having an isocyanate group is 0.5 to 40% by weight, 1 to 30% by weight, or 2 to 20% by weight. When the content is less than 0.5% by weight, hot offset resistance, heat-resistant storage stability, and low-temperature fixability of the toner may be poor. When the content is greater than 40% by weight, low-temperature fixability of the toner may be poor.

In some embodiments, the average number of isocyanate groups included in one molecule of the polyester prepolymer (A) having an isocyanate group is 1 or more, 1.2 to 5, or 1.5 to 4. When the average number of isocyanate groups is less than 1, hot offset resistance of the toner may be poor because molecular weight of the modified polyester (RMPE) having an urea-bond-forming group is too small.

In some embodiments, THF-soluble components in the polymer reactive with the compound having an active hydrogen group has a weight average molecular weight (Mw) of 3,000 to 40,000 or 4,000 to 30,000 measured by gel permeation chromatography (GPC). When the weight average molecular weight (Mw) is less than 3,000, heat-resistant storage stability of the toner may be poor. When the weight average molecular weight (Mw) is greater than 40,000, low-temperature fixability of the toner may be poor.

Molecular weight distribution can be measured by gel permeation chromatography (GPC) as follows. After stabilizing columns in a heat chamber at 40° C., flow THF (tetrahydrofuran) in the columns at a flow rate of 1 ml/min. Inject 50 to 200 μl of a THF solution of a sample having a concentration of 0.05 to 0.6% by weight. Molecular weight is determined with reference to a calibration curve compiled from several kinds of monodisperse polystyrene standard samples. The calibration curve may be complied from, for example, about 10 polystyrene standard samples having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, available from Pressure Chemical Company or Tosoh Corporation. A refractive index detector can be used as the detector.

The toner may further includes a colorant, a release agent, a charge controlling agent, inorganic fine particles, a fluidity improving agent, a cleanability improving agent, a magnetic material, and/or a metal salt.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

In some embodiments, the content of the colorants in the toner is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene derivatives, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Specific examples of usable polymers of styrene or styrene derivatives include, but are not limited to, polystyrene, poly-p-chlorostyrene, and polyvinyl toluene. Specific examples of usable styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used. The colorant can be included in an arbitrary resin phase, i.e., the main body (the first resin phase), the layer B (the second resin phase), or the layer A (the third resin phase), by controlling affinity difference. When the colorant is included in the inner first resin phase, charging properties such as environmental stability, charge retaining ability, and charge amount of the toner may not deteriorate.

In some embodiments, the toner includes a release agent having a melting point of 50 to 120° C. In a case in which such a low-melting-point release agent is dispersed in the binder resin, the toner can be effectively release from a fixing roller when the toner is fixed on a recording medium by being pressed by the fixing roller. Thus, the toner does not cause hot offset problem even when the fixing roller is not applied with any release agent such as oil.

Specific examples of such release agents include, but are not limited to, waxes. Specific examples of usable waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax). Specific examples of usable waxes further include, but are not limited to, synthetic hydrocarbon waxes (e.g., Fischer-Tropsch wax, polyethylene wax) and synthetic waxes (e.g., ester wax, ketone wax, ether wax). Further, the following materials are also usable as the release agent: fatty acid amides such as 1,2-hydroxystearic acid amide, stearic acid amide, phthalic anhydride imide, and chlorinated hydrocarbon; homopolymers and copolymers of polyacrylates (e.g., n-stearyl polymethacrylate, n-lauryl polymethacrylate), which are low-molecular-weight crystalline polymers; and crystalline polymers having a long alkyl side chain. Two or more of these materials can be used in combination.

In some embodiments, the release agent has a melting point of 50 to 120° C. or 60 to 90° C. When the melting point is less than 50° C., heat-resistant storage stability of the toner may be poor. When the melting point is greater than 120° C., cold offset resistance of the toner may be poor. In some embodiments, the release agent has a melt-viscosity of 5 to 1,000 cps or 10 to 100 cps, at a temperature 20° C. higher than the melting point. When the melt-viscosity is less than 5 cps, releasability of the toner may be poor. When the melt-viscosity is greater than 1,000 cps, hot offset resistance and low-temperature fixability of the toner may be poor. In some embodiments, the content of the release agent in the toner is 0 to 40% by weight or 3 to 30% by weight. When the content of the release agent is greater than 40% by weight, fluidity of the toner may be poor.

The release agent can be included in an arbitrary resin phase, i.e., the resin P in the core particle (the first resin phase), the acrylic resin A in the inner shell layer (the second resin phase), or the styrene-acrylic resin B in the outer shell layer (the third resin phase), by controlling affinity difference. When the release agent is included in the second and third resin phases, the release agent can sufficiently exude upon application of heat within a short time period. When the release agent is included in the first resin phase, the release agent is prevented from contaminating photoreceptor and carrier particles.

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Two or more of these materials can be used in combination.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.;

TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

The charge controlling agent can be included in an arbitrary resin phase, i.e., the resin P in the core particle (the first resin phase), the acrylic resin A in the inner shell layer (the second resin phase), or the styrene-acrylic resin B in the outer shell layer (the third resin phase), by controlling affinity difference. When the charge controlling agent is included in the second or third resin phase, the charge controlling agent exerts an effect in a small amount. When the charge controlling agent is included in the first resin phase, the charge controlling agent is prevented from contaminating photoreceptor and carrier particles.

In some embodiments, the content of the charge controlling agent is 0.1 to 10 parts by weight or 0.2 to 5 parts by weight, based on 100 parts by weight of the binder resin. When the content of the charge controlling agent is less than 0.1 parts by weight, it is difficult to control charge of the toner. When the content of charge controlling agent is greater than 10 parts by weight, the toner may be excessively charged and excessively electrostatically attracted to a developing roller, resulting in poor fluidity of the developer and low image density.

The toner may further include fine particles of an inorganic material on the surface thereof to improve fluidity, developability, and chargeability. Specific examples of usable inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination.

Both large-sized inorganic fine particles having a particle diameter of 80 to 500 nm small-sized inorganic fine particles can be used. In some embodiments, the toner includes hydrophobized silica particles or hydrophobized titanium dioxide particles having a primary average particle diameter of 5 to 50 nm or 10 to 30 nm. In some embodiments, the fine particles have a BET specific surface of 20 to 500 $m^2/g$. In some embodiments, the toner includes large-sized inorganic fine particles and small-sized inorganic fine particles each in an amount of 0.01 to 5% by weight or 0.01 to 2.0% by weight.

In some embodiments, the inorganic material (e.g., silica, titanium oxide) is surface-treated with a fluidity improving agent, such as a silane coupling agent, a silylation agent, a silane coupling agent having a fluorinated alkyl group, an organic titanate coupling agent, an aluminum coupling agent, a silicone oil, and a modified silicone oil, to improve hydrophobicity. Such a hydrophobized inorganic material does not degrade fluidity and chargeability even in high-humidity conditions.

The toner may further include a cleanability improving agent so as to be easily removable from a photoreceptor or a primary transfer medium when remaining thereon after image transfer. Specific examples of usable cleanability improving agents include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, the fine particles of polymers have a narrow size distribution and a volume average particle diameter of 0.01 to 1 μm.

Specific examples of usable magnetic materials include, but are not limited to, iron powder, magnetite, and ferrite. In some embodiments, a magnetic material having a whitish color is used.

In some embodiments, the toner is produced by dissolving or dispersing toner constituents including at least the polyester resin P or a precursor thereof in an organic solvent to prepare a solution or dispersion of the toner constituents, emulsifying the solution or dispersion of the toner constituents in an aqueous medium containing fine particles of the acrylic resin A and the styrene-acrylic resin B to prepare an emulsion, removing the organic solvent from the emulsion after the fine particles of the acrylic resin A are fixed to the surfaces of precursors of toner particles, heating the aqueous medium containing the toner particles. In some embodiments, the toner is produced by emulsifying a solution or dispersion of toner constituents including a compound having an active hydrogen group and a polymer reactive with the compound in an aqueous medium, reacting the compound having an active hydrogen group with the polymer in the aqueous medium to produce precursors of toner particles, and fixing fine particles of the acrylic resin A to the surfaces of the precursors of toner particles.

The solution or dispersion of toner constituents is prepared by dissolving or dispersing toner constituents in a solvent. The toner constituents may include, for example, a binder resin, a compound having an active hydrogen group, a polymer reactive with the compound having an active hydrogen group, a release agent, and a charge controlling agent. In some embodiments, the solution or dispersion of toner constituents is prepared by dissolving or dispersing toner constituents in an organic solvent. The organic solvent may be removed during or after the process of forming toner particles.

The organic solvent may be a volatile solvent having a boiling point less than 150° C., which is easily removable. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In some embodiments, an ester solvent is used. In some embodiments, ethyl acetate is used. Two or more of these solvents can be used in combination. In some embodiments, the used amount of the organic solvent is 40 to 300 parts by weight, 60 to 140 parts by weight, or 80 to 120 parts by weight, based on 100 parts by weight of the toner components. As described above, the solution or dispersion of toner constituents is prepared by dissolving or dispersing toner constituents such as a compound having an active hydrogen group, a polymer reactive with the compound having an active hydrogen group, an unmodified polyester resin, a release agent, a colorant, and a charge controlling agent in an organic solvent. The toner constituents other than the polymer reactive with the compound having an active hydrogen group may be either previously mixed with the aqueous medium or added to the aqueous medium when the solution or dispersion of toner constituents is emulsified therein.

The aqueous medium may be, for example, water, a water-miscible solvent, or a mixture thereof. Specific examples of usable water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone. Two or more of these colorants can be used in combination.

Fine particles of the styrene-acrylic resin B are dispersed in the aqueous medium in the presence of an anionic surfactant. In some embodiments, the added amount of the anionic surfactant and fine particles of the styrene-acrylic resin B is each 0.5 to 10% by weight. Fine particles of the acrylic resin A are added to the aqueous medium thereafter. In a case in which the fine particles of the acrylic resin A and the anionic surfactant are cohesive, the aqueous medium may be subjected to a dispersion treatment with a high-speed shearing disperser before the process of emulsification.

The solution or dispersion of toner constituents may be kept agitated when being emulsified in the aqueous medium. The emulsification may be performed using a low-speed shearing disperser or a high-speed shearing disperser, for example. During the emulsification, the compound having an active hydrogen group is elongated or cross-linked with the polymer reactive with the compound having an active hydrogen group, thereby producing an adhesive base material (i.e., a binder resin). Fine particles of the acrylic resin A may be added to the aqueous medium either during or after the emulsification. In particular, fine particles of the acrylic resin A can be added to the aqueous medium either during the emulsification while the aqueous medium is agitated by a high-speed shearing disperser, or after the emulsification while the aqueous medium is agitated by a low-speed sharing disperser. It depends on the degree of adherence or fixation of the fine particles of the acrylic resin A.

Glass transition temperature (Tg) can be measured with instruments TA-60WS and DSC-60 from Shimadzu Corporation under the following conditions.

Measurement Conditions
Sample container: Aluminum sample pan (with a lid)
Sample amount: 5 mg
Reference: Aluminum sample pan (containing 10 mg of alumina)
Atmosphere: Nitrogen gas (Flow rate: 50 ml/min)
Temperature profile
Start temperature: 20° C.
Heating rate: 10° C./min
End temperature: 150° C.
Retention time None
Cooling rate: 10° C./min
End temperature: 20° C.
Retention time None
Heating rate: 10° C./min
End temperature: 150° C.

The measured data is analyzed with a data analysis software program (TA-60 version 1.52) from Shimadzu Corporation as follows. First, a DrDSC curve that is a differential curve of a DSC curve obtained in the second heating is analyzed with a peak analysis function of the analysis software program while designating a temperature range of ±5° C. from a lowest-temperature peak observed in the DrDSC curve, to determine the peak temperature of the DSC curve. Next, the DSC curve is analyzed with the peak analysis function of the analysis software program while designating a temperature range of ±5° C. from the peak temperature to determine the maximum endothermic temperature. The maximum endothermic temperature thus determined is regarded as glass transition temperature.

The flow beginning temperature (Tfb) and ½ method temperature (T½) are determined from a flow curve obtained with a capillary rheometer FLOWTESTER CFT500 (from Shimadzu Corporation).

In some embodiments, the toner has a Tfb of 60° C. or more, or 80 to 120° C. When Tfb falls below 60° C., at least heat-resistant storage stability or offset resistance may deteriorate.

In some embodiments, T½ of the resin P is 50 to 80° C., T½ of the acrylic resin A is 130 to 180° C., and/or T½ of the styrene-acrylic resin B is 130 to 190° C.

Measurement conditions are as follows.
Load: 30 kg/cm$^2$
Heating rate: 3.0° C./min
Preheating time: 200 sec
Die diameter 1.0 mm
Die length: 1.0 mm
Cylinder pressure: $2.942\times10^6$ Pa
Shear stress: $7.355\times10^5$ Pa The toner may include a combination of an urea-modified polyester resin and an unmodified polyester resin. The urea-modified polyester resin may be obtained by reacting an amine (B), serving as a compound having an active hydrogen group, with a polyester prepolymer (A) having an isocyanate group, serving as a polymer reactive with the compound having an active hydrogen group. The urea-modified polyester resin may have urethane bond other than urea bond. In this case, the molar ratio of urea bonds to urethane bonds may be 100/0 to 10/90, 80/20 to 20/80, or 60/40 to 30/70. When the molar ratio of urea bonds falls below 10, hot offset resistance may deteriorate.

Specific combinations of (a) an urea-modified polyester resin with (b) an unmodified polyester resin include the following combinations (1) to (10).

(1) (a) Urea-modified polyester obtained by reacting isophoronediamine with a prepolymer obtained by reacting isophorone diisocyanate with a polycondensation product of ethylene oxide 2 mol adduct of bisphenol A and isophthalic acid. (b) A polycondensation product of ethylene oxide 2 mol adduct of bisphenol A and isophthalic acid.

(2) (a) Urea-modified polyester obtained by reacting isophoronediamine with a prepolymer obtained by reacting isophorone diisocyanate with a polycondensation product of ethylene oxide 2 mol adduct of bisphenol A and isophthalic acid. (b) A polycondensation product of ethylene oxide 2 mol adduct of bisphenol A and terephthalic acid.

(3) (a) Urea-modified polyester obtained by reacting isophoronediamine with a prepolymer obtained by reacting isophorone diisocyanate with a polycondensation product of ethylene oxide 2 mol adduct of bisphenol A, propylene oxide 2 mol adduct of bisphenol A, and terephthalic acid. (b) A polycondensation product of ethylene oxide 2 mol adduct of bisphenol A, propylene oxide 2 mol adduct of bisphenol A, and terephthalic acid.

(4) (a) Urea-modified polyester obtained by reacting isophoronediamine with a prepolymer obtained by reacting isophorone diisocyanate with a polycondensation product of ethylene oxide 2 mol adduct of bisphenol A, propylene oxide 2 mol adduct of bisphenol A, and terephthalic acid. (b) A polycondensation product of propylene oxide 2 mol adduct of bisphenol A and terephthalic acid.

(5) (a) Urea-modified polyester obtained by reacting hexamethylenediamine with a prepolymer obtained by reacting isophorone diisocyanate with a polycondensation product of ethylene oxide 2 mol adduct of bisphenol A and terephthalic acid. (b) A polycondensation product of ethylene oxide 2 mol adduct of bisphenol A and terephthalic acid.

(6) (a) Urea-modified polyester obtained by reacting hexamethylenediamine with a prepolymer obtained by reacting isophorone diisocyanate with a polycondensation product of ethylene oxide 2 mol adduct of bisphenol A and terephthalic acid. (b) A polycondensation product of ethylene oxide 2 mol adduct of bisphenol A, propylene oxide 2 mol adduct of bisphenol A, and terephthalic acid.

(7) (a) Urea-modified polyester obtained by reacting ethylenediamine with a prepolymer obtained by reacting isophorone diisocyanate with a polycondensation product of ethylene oxide 2 mol adduct of bisphenol A and terephthalic acid. (b) A polycondensation product of ethylene oxide 2 mol adduct of bisphenol A and terephthalic acid.

(8) (a) Urea-modified polyester obtained by reacting hexamethylenediamine with a prepolymer obtained by reacting diphenylmethane diisocyanate with a polycondensation product of ethylene oxide 2 mol adduct of bisphenol A and isophthalic acid. (b) A polycondensation product of ethylene oxide 2 mol adduct of bisphenol A and isophthalic acid.

(9) (a) Urea-modified polyester obtained by reacting hexamethylenediamine with a prepolymer obtained by reacting diphenylmethane diisocyanate with a polycondensation product of ethylene oxide 2 mol adduct of bisphenol A, propylene oxide 2 mol adduct of bisphenol A, terephthalic acid, and dodecenyl succinic anhydride. (b) A polycondensation product of ethylene oxide 2 mol adduct of bisphenol A, propylene oxide 2 mol adduct of bisphenol A, and terephthalic acid.

(10) (a) Urea-modified polyester obtained by reacting hexamethylenediamine with a prepolymer obtained by reacting toluene diisocyanate with a polycondensation product of ethylene oxide 2 mol adduct of bisphenol A and isophthalic acid. (b) A polycondensation product of ethylene oxide 2 mol adduct of bisphenol A and isophthalic acid.

The urea-modified polyester resin may be obtained by, for example, (1) emulsifying a solution or dispersion of toner constituents including a polymer reactive with a compound having an active hydrogen group (e.g., a polyester prepolymer (A) having an isocyanate group) along with a compound having an active hydrogen group (e.g., an amine (B)) in an aqueous medium, thus forming oil droplets and causing an elongating or cross-linking reaction between the polymer and the compound therein; (2) emulsifying the solution or dispersion of toner constituents in an aqueous medium to which the compound having an active hydrogen group is previously added, thus forming oil droplets and causing an elongating or cross-linking reaction between the polymer and the compound therein; or (3) adding the solution or dispersion of toner constituents in an aqueous medium and thereafter further adding the compound having an active hydrogen group thereto, thus forming oil droplets and causing an elongating or cross-linking reaction between the polymer and the compound therein. In the case (3), the resulting urea-modified polyester resin is dominantly formed at the surface of the toner particle, generating a concentration gradient of urea bonds within the toner particle.

The reaction time may be, for example, 10 minutes to 40 hours, or 2 to 24 hours.

The solution or dispersion of toner constituents is prepared by dissolving or dispersing toner constituents, such as a polymer reactive with a compound having an active hydrogen group (e.g., a polyester prepolymer (A) having an isocyanate group), a colorant, a release agent, a charge controlling agent, and an unmodified polyester resin, in an organic solvent. The solution or dispersion of toner constituents thus prepared is dispersed in an aqueous medium by application of shearing force to form a stable emulsion.

In some embodiments, the used amount of the aqueous medium is 50 to 2,000 parts by weight, or 100 to 1,000 parts by weight, based on 100 parts by weight of the toner constituents. When the amount of the aqueous medium falls below 50 parts by weight, the toner constituents may not be finely dispersed in resulting toner particles and the toner particles may not have a desired particle size. When the amount of the aqueous medium exceeds 2,000 parts by weight, manufacturing cost may increase.

The aqueous medium may contain an inorganic dispersant and/or a polymeric protection colloid other than the anionic surfactant and the styrene-acrylic resin particles. Specific examples of usable inorganic dispersants which are poorly-water-soluble include, but are not limited to, tricalcium phosphate, calcium carbonate, titanium oxide, colloidal silica, and hydroxyapatite.

Specific examples of usable polymeric protection colloids include, but are not limited to, homopolymers and copolymers obtained from monomers, such as acids, hydroxyl-group-containing acrylates and methacrylates, vinyl alcohols and vinyl alcohol ethers, esters of vinyl alcohols with carboxyl-group-containing compounds, amides and methylol compounds thereof, chlorides, monomers containing nitrogen or a nitrogen-containing heterocyclic ring; polyoxyethylenes; and celluloses. Specific examples of usable acids include, but are not limited to, acrylic acid, methacrylic acid, α-cyanoacrylic acid, α-cyanomethacrylic acid, itaconic acid, crotonic acid, fumaric acid, maleic acid, and maleic anhydride. Specific examples of usable hydroxyl-group-containing acrylates and methacrylates include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, and glycerin monomethacrylate.

Specific examples of usable vinyl alcohols and vinyl alcohol ethers include, but are not limited to, vinyl methyl ether, vinyl ethyl ether, and vinyl propyl ether. Specific examples of usable esters of vinyl alcohols with carboxyl-group-containing compounds include, but are not limited to, vinyl acetate, vinyl propionate, and vinyl butyrate. Specific examples of usable amides and methylol compounds thereof include, but are not limited to, acrylamide, methacrylamide, diacetone acrylamide, N-methylol acrylamide, and N-methylol methacrylamide.

Specific examples of usable chlorides include, but are not limited to, acrylic acid chloride and methacrylic acid chloride. Specific examples of usable monomers containing nitrogen or a nitrogen-containing heterocyclic ring include, but are not limited to, vinyl pyridine, vinyl pyrrolidone, vinyl imidazole, and ethylene imine.

Specific examples of usable polyoxyethylenes include, but are not limited to, polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester. Specific examples of usable celluloses include, but are not limited to, methyl cellulose, hydroxyethyl cellulose, and hydroxypropyl cellulose.

In a case in which a dispersant soluble in acids and bases (e.g., calcium phosphate) is used, the resulting toner particles are first washed with an acid (e.g., hydrochloric acid) and then washed with water, or washed with an enzyme, to remove the dispersant.

The organic solvent is removed from the emulsion. The organic solvent can be removed from the emulsion by (1) gradually heating the emulsion to completely evaporate the organic solvent from oil droplets or (2) spraying the emulsion into dry atmosphere to completely evaporate the organic solvent from oil droplets. In the case (2), aqueous dispersants, if any, can also be evaporated. After complete removal of the organic solvent from the emulsion, toner particles are obtained.

The toner particles thus obtained are washed with ion-exchange water and a dispersion of the toner particles having a desired conductivity is prepared.

The dispersion is then heated either statically or under agitation, so that the surfaces of the toner particles are smoothened. Alternatively, the toner particles can be heated either before or after being washed with ion-exchange water.

After being dried, the toner particles are classified by size. Undesired fine particles are removed by cyclone separation, decantation, or centrifugal separation, for example. Of course, the classification treatment can be performed after drying the resulting particles.

An image forming method according to an embodiment includes: a charging process in which a charger charges an electrophotographic photoreceptor; an irradiation process in which an irradiator irradiates the charged electrophotographic photoreceptor to form an electrostatic latent image thereon; a developing process in which a developing device develops the electrostatic latent image into a toner image with the toner according to an embodiment; a primary transfer process in which a primary transfer device primarily transfers the toner image from the electrophotographic photoreceptor onto an intermediate transfer member; a secondary transfer process in which a secondary transfer device secondarily transfers the toner image from the intermediate transfer member onto a recording medium; a fixing process in which a fixing device fixes the toner image on the recording medium by application of heat and pressure; and a cleaning process in which a cleaner removes residual toner particles remaining on the intermediate transfer member without being transferred onto the recording medium. In some embodiments, the toner image is transferred from the intermediate transfer member onto the recording medium at a linear speed of 100 to 1,000 mm/sec within a time period of 0.5 to 60 msec. In some embodiments, the image forming method is applied to full-color tandem electrophotographic image forming methods.

Figure 2:
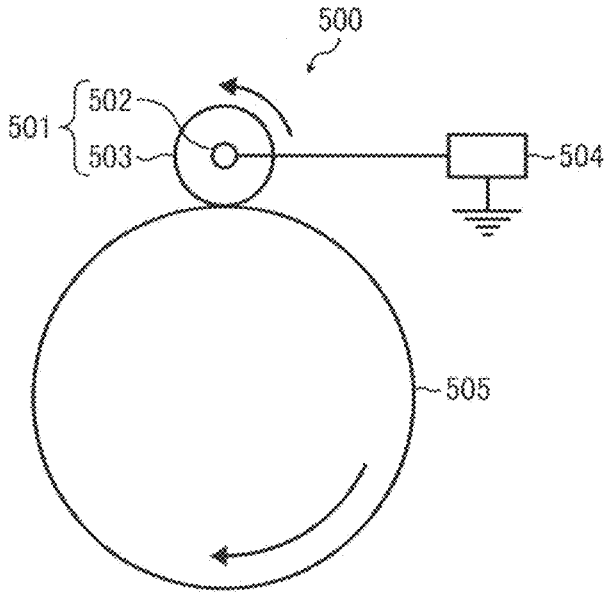
FIGS. 2 and 3 are schematic views of contact chargers usable in an image forming method according to an embodiment.
Figure 3:
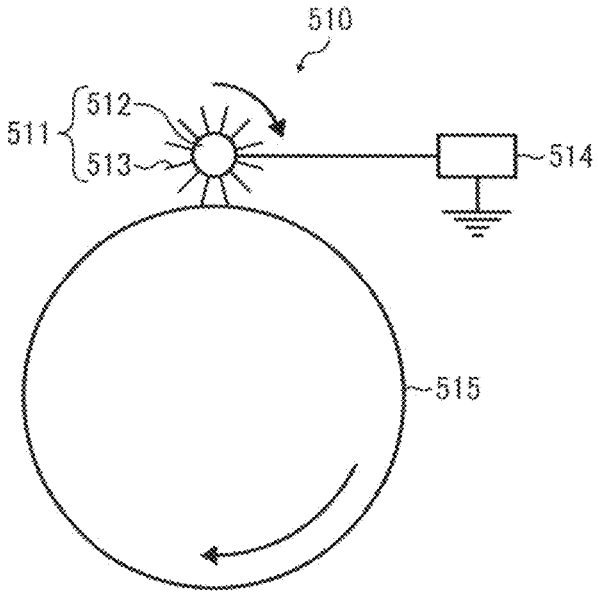

FIGS. 2 and 3 are schematic views of contact chargers usable in an image forming method according to an embodiment.

In FIG. 2, a roller-type charger 500 is illustrated. A photoreceptor 505, serving as an image bearing member, is driven to rotate in a direction indicated by arrow at a predetermined speed. The photoreceptor 505 is in contact with a charging roller 501. The charging roller 501 is comprised of a cored bar 502 and a conductive rubber layer 503 concentrically disposed on the outer periphery of the cored bar 502. Both ends of the cored bar 502 are rotatably supported with bearings. The charging roller 501 is pressed against the photoreceptor 505 by a pressing unit. The charging roller 501 is rotated as the photoreceptor 505 is driven to rotate. The cored bar 502 has a diameter of 9 mm and the conductive rubber layer 503 has a middle resistivity of 100,000 Ω·cm. The charging roller 501 has a diameter of 16 mm. The cored bar 502 is electrically connected to a power source 504. The power source 504 supplies a predetermined bias to the charging roller 501. Thus, a peripheral surface of the photoreceptor 505 is uniformly charged to a predetermined potential with a predetermined polarity.

Other than the roller-type charger, a magnetic-brush-type charger and a fur-brush-type charger can also be used. In the magnetic-brush-type charger, the magnetic brush is formed of ferrite (e.g., Zn—Cu ferrite) particles, serving as charging members, a non-magnetic conductive sleeve that supports the ferrite particles, and a magnet roll contained in the conductive sleeve. In the fur-brush-type charger, the fur brush is formed of a fur which is treated with a material such as carbon, copper sulfide, a metal, or a metal oxide to have conductivity. The conductive fur is wound around or attached to a metal or a conductive cored bar.

In FIG. 3, a brush-type charger 510 is illustrated. A photoreceptor 515, serving as an image bearing member, is driven to rotate in a direction indicated by arrow at a predetermined speed. A fur brush roller 511 presses the photoreceptor 515 at a predetermined pressure countering elasticity of a brush part 513 to form a nip having a predetermined width.

The fur brush roller 511 is comprised of a metallic cored bar 512 having a diameter of 6 mm, serving as an electrode, and the brush part 513 formed of a pile fabric tape of a conductive rayon fiber REC-B (from Unitika Ltd.) spirally wound around the cored bar 512. The fur brush roller 511 has an outer diameter of 14 mm and a longitudinal length of 250 mm The bristle of the brush part 513 is formed of filaments of 300 denier/50 filaments and has a density of 155 filaments per 1 $mm^2$. The bristles of the brush have been slanted by inserting the fur brush roller 511 into a pipe having an inner diameter of 12 mm while rotating in a certain direction so that the fur brush roller and the pipe are concentrically disposed, and leaving them in a high-temperature and high-humidity atmosphere.

The fur brush roller 511 has a resistance of $1\times10^5\Omega$ when is supplied with a voltage of 100 V. This resistance value is converted from the current value measured when the fur brush roller is brought in contact with a metallic drum having a diameter of 30 mm while forming a nip having a width of 3 mm and a voltage of 100 V is supplied thereto. When the fur brush roller 511 has a resistance of $10^4\Omega$ or more, the photoreceptor 515 is prevented from being insufficiently charged even when the photoreceptor 515 has low pressure-resistant defective parts, such as pin holes, and leakage current excessively flows into the defective parts. When the fur brush roller 511 has a resistance of $10^7\Omega$ or less, the surface of the photoreceptor 515 can be sufficiently injected with charge.

The bristles of the brush is formed of a material such as REC-B, REC-C, REC-M1, and REC-M10 (from Unitika Ltd.), SA-7 (from Toray Industries, Inc.), THUNDERON (from Nihon Sanmo Dyeing Co., Ltd.), BELLTRON (from KB SEIREN, Ltd.), CLACARBO (from Kuraray Trading Co., Ltd.), rayons in which carbon is dispersed, and ROVAL (from Mitsubishi Rayon Co., Ltd.). Each bristles are 3 to 10 denier and include 10 to 100 filaments. The brush density is 80 to 600 bristles/mm. The length of the bristle is 1 to 10 mm.

The fur brush roller 511 is driven to rotate so as to face in the direction of rotation of the photoreceptor 515 at a predetermined peripheral speed. The fur brush roller 511 contacts the photoreceptor 515 with a speed difference therebetween. Upon application of a predetermined voltage from a power source 514 to the fur brush roller 511, the peripheral surface of the fur brush roller 511 that is rotating is uniformly charged to a predetermined potential with a predetermined polarity.

During contact charging of the photoreceptor 515 by the fur brush roller 511, direct injection charging is dominant. The peripheral surface of the fur brush roller 511 that is rotating is charged to almost the same potential to the applied voltage.

The charging member is not limited to the fur brush roller 511 and may take a form of a charging roller, a magnetic brush, etc. For example, a charging roller comprised of a cored bar covered with a rubber layer having a middle resistivity of about 100,000 Ω·cm can be used. In the magnetic-brush-type charger, the magnetic brush is formed of ferrite (e.g., Zn—Cu ferrite) particles, serving as charging members, a non-magnetic conductive sleeve that supports the ferrite particles, and a magnet roll contained in the conductive sleeve.

According to an embodiment, the magnetic brush is formed of magnetic ferrite particles coated with a middle-resistivity resin layer. The ferrite particles is a mixture of 1 part by weight of Zn—Cu ferrite particles having an average particle diameter of 25 μm and 0.05 parts by weight of Zn—Cu ferrite particles having an average particle diameter of 10 μm. Thus, the ferrite particles have an average particle diameter of 25 μm. The magnetic brush is formed of the coated magnetic particles, a non-magnetic conductive sleeve that supports the magnetic particles, and a magnet roller contained in the conductive sleeve. The sleeve is covered with a layer of the coated magnetic particles having a thickness of 1 mm and forms a charging nip having a width of about 5 mm between the photoreceptor. The gap between the sleeve that is bearing the coated magnetic particles and the photoreceptor is about 500 μm. The magnet roll is rotated so that the peripheral surface of the sleeve is rotated so as to face in the direction of rotation of the photoreceptor while abrasively contacting the photoreceptor at a twice the peripheral speed of the photoreceptor.

Figure 4:
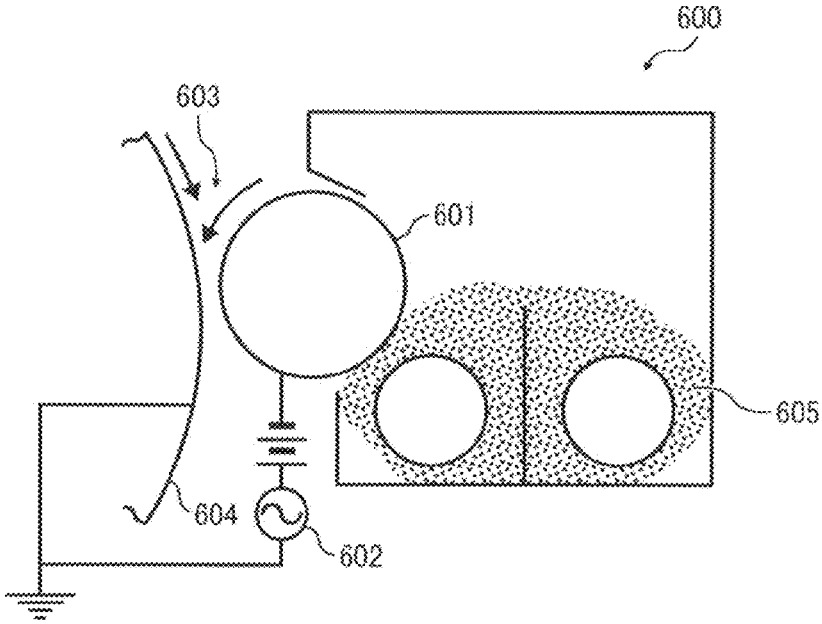
FIG. 4 is a schematic view of a developing device usable in an image forming method according to an embodiment.

In some embodiments, a latent image formed on the photoreceptor is developed upon application of an alternating electric field. FIG. 4 is a schematic view of a developing device usable in an image forming method according to an embodiment. In a developing device 600, a developing sleeve 601 is supplied with a developing bias from a power source 602. The developing bias is a vibrating bias voltage in which an alternating current voltage is overlapped with a direct current voltage. Potentials at both background and image areas are within a range between the maximum and minimum values of the vibrating bias voltage. An alternating electric field is formed at a developing part 603. Toner particles 605 according to an embodiment and carrier particles are excited in the alternating electric field. The toner particles 605 fly toward a photoreceptor 604 getting free from electrostatic binding force to the developing sleeve 601 and carrier particles and adhere to the latent image on the photoreceptor 604.

The difference between the maximum and minimum values of the vibrating bias voltage may be 0.5 to 5 kV and the vibrating frequency may be 1 to 10 kHz. The vibrating bias voltage may take either a rectangular wave shape, a sine wave shape, or a triangular wave shape. The direct current voltage component in the vibrating bias voltage is within a range between the background area potential and the image area potential. When the direct current voltage component is closer to the background area potential than the image area potential, toner particles are prevented from scattering onto the background area.

When the vibrating bias voltage has a rectangular wave shape, the duty rate may be 50% or less. The duty rate is a rate of time in one cycle of the vibrating bias during which toner particles fly toward a photoreceptor. When the duty rate is within the above range, it is possible to enlarge the difference between the time average bias value and a peak bias value at a time toner particles fly toward a photoreceptor. Thus, toner particles can be more excited and adhered to a latent image precisely following the potential distribution, resulting in improvement of granularity and resolution of the resulting image. Additionally, it is possible to reduce the difference between the time average bias value and another peak bias value at a time carrier particles having the opposite polarity to the toner particles fly toward the photoreceptor. Thus, carrier particles can be more calmed down and prevented from scattering onto background areas in the latent image.

Figure 5:
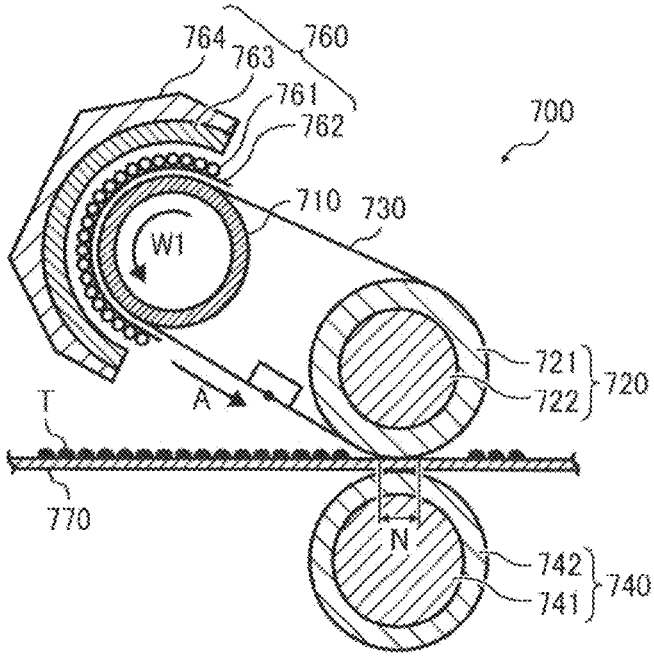
FIG. 5 is a schematic view of a fixing device usable in an image forming method according to an embodiment.

FIG. 5 is a schematic view of a fixing device usable in an image forming method according to an embodiment. A fixing device 700 includes a heating roller 710, a fixing roller 720, a seamless fixing belt 730, and a pressing roller 740. The heating roller 710 is heatable by electromagnetic induction of an induction heater 760. The fixing roller 720 is disposed in parallel with the heating roller 710. The fixing belt 730 is stretched between the heating roller 710 and the fixing roller 720 and is heatable by the heating roller 720 and rotatable in a direction indicated by arrow A as at least one of the heating roller 710 and the fixing roller 720 rotates. The pressing roller 704 is pressed against the fixing roller 720 with the fixing belt 730 therebetween and is rotatable in a forward direction relative to the fixing belt 730.

The heating roller 710 is comprised of a hollow cylinder made of a magnetic metallic material such as iron, cobalt, nickel, or alloys thereof. The heating roller 710 has an outer diameter of 20 to 40 mm, a wall thickness of 0.3 to 1.0 mm, and a low heat capacity.

The fixing roller 720 is comprised of a cored bar 721 made of a metal such as stainless steel and an elastic member 722 covering the cored bar 721. The elastic member 722 is made of a solidified or foamed heat-resistant silicone rubber. The pressing roller 740 is pressed against the fixing roller 720 forming a contact part with a predetermined width.

The fixing roller 720 has an outer diameter of about 20 to 40 mm, which is greater than that of the heating roller 710. The elastic member 722 has a wall thickness of 4 to 6 mm. With the above configuration, the heating roller 710 can be rapidly heated and warm-up time can be reduced because heat capacity of the heating roller 710 is smaller than that of the fixing roller 720.

The fixing belt 730 is heated at a contact part W1 where the fixing belt 730 is in contact with the heating roller 710 that is heated by the induction heater 760. The inner surface of the fixing belt 730 is sequentially heated as the heating roller 710 and the fixing roller 720 rotate and finally the fixing belt 730 in whole is heated.

Figure 6:
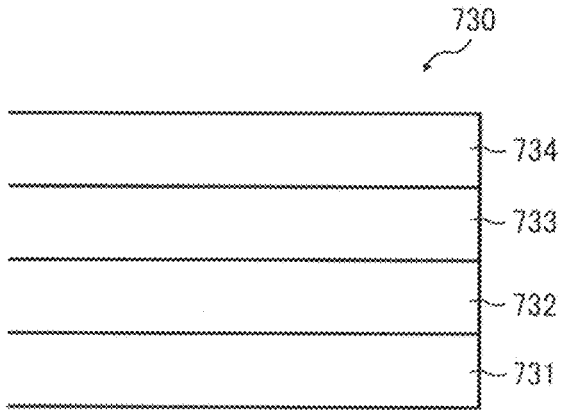
FIG. 6 is a cross-sectional schematic view of the fixing belt included in the fixing device illustrated in FIG. 5.

FIG. 6 is a cross-sectional schematic view of the fixing belt 730. The fixing belt 730 includes, from the innermost side thereof, a base layer 731, a heat generation layer 732, an intermediate layer 732, and a release layer 734.

The base layer 731 comprises a resin such as polyimide (PI). The heat generation layer 732 comprises a conductive material such as Ni, Ag, and SUS. The intermediate layer 733 is an elastic layer for uniformly fixing toner images. The release layer 734 comprises a resin such as a fluorine-containing resin for improving releasability.

The thickness of the release layer 734 may be 10 to 300 μm, or around 200 μm. The fixing belt 730 with such a thickness is able to sufficiently cover over a toner image T formed on a recording medium 770 and to uniformly melt it upon application of heat. The thickness of the release layer 734 is 10 μm at the minimum so as to secure abrasion resistance. When the thickness of the release layer 734 exceeds 300 μm, heat capacity of the fixing belt 730 gets so large that the warm-up time gets longer. Additionally, the fixing belt 730 gets more difficult to reduce its surface temperature and therefore the melted toner particles are not likely to aggregate at the exit of the fixing part. As a result, the toner particles are undesirably adhered to the fixing belt 730. This phenomenon is so-called hot offset. The heat generation layer 732 may function as a base layer. The base layer may include heat-resistant resins such as fluorine-containing resins, polyimide resins, polyamide resins, polyamideimide resins, PEEK resins, PES resins, and PPS resins.

The pressing roller 740 is comprised of a cored bar 741 and an elastic member 742 covering the cored bar 741. The cored bar 741 is formed of a cylindrical member made of a highly thermal conductive metal such as copper or aluminum. The elastic member 742 has high heat resistance and toner releasability. The cored bar 741 may be made of SUS. The pressing roller 740 presses against the fixing roller 720 with the fixing belt 730 therebetween to form a fixing nip N. The pressing roller 740 has a higher hardness than the fixing roller 720 and therefore the pressing roller 740 slightly bites into the fixing roller 720 (and the fixing belt 730). This configuration makes the recording medium 770 follow the circumferential surface of the pressing roller 740 and get more separable from the surface of the fixing belt 730. The pressing roller 740 has an outer diameter of about 20 to 40 mm, which is similar to that of the fixing roller 720, and a wall thickness of 0.5 to 2.0 mm, which is smaller than that of the fixing roller 720.

The induction heater 760 includes an exciting coil 761 for generating a magnetic field and a coil guide plate 762 around which the exciting coil 761 is wound. The coil guide plate 762 has a half cylindrical shape and is disposed adjacent to the outer periphery of the heating roller 710. The exciting coil 761 is formed of a single long exiting wire rod alternately wound around the coil guide plate 762 in the axial direction of the heating roller 710. The exciting coil 761 is connected to a driving power source having a frequency-variable oscillation circuit. An exciting coil core 763 having a half cylindrical shape is fixed to an exciting coil core support 764 and is disposed adjacent to the exciting coil 761. The exciting coil core 763 is comprised of a ferromagnetic material such as ferrite.

A process cartridge according to an embodiment is detachably attachable to image forming apparatus and includes an electrophotographic photoreceptor to bear an electrostatic latent image, and a developing device containing the toner according to an embodiment. The developing device is configured to develop the electrostatic latent image into a toner image with the toner.

Figure 7:
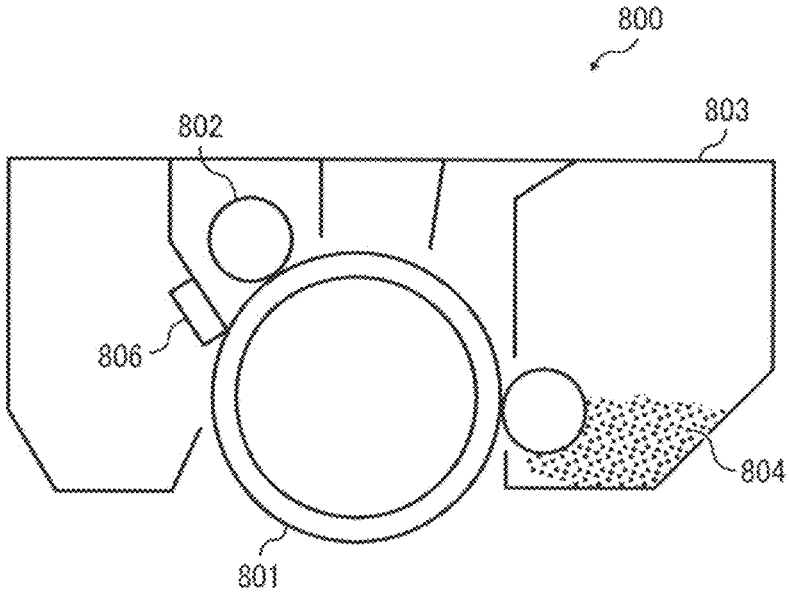
FIG. 7 is a schematic view of a process cartridge according to an embodiment.

FIG. 7 is a schematic view of a process cartridge according to an embodiment. A process cartridge 800 includes a photoreceptor 801, a charger 802, a developing device 803, and a cleaner 806. The photoreceptor 801 is driven to rotate at a predetermined peripheral speed. A peripheral surface of the photoreceptor 801 is uniformly charged by the charger 802 to a predetermined positive or negative potential and then exposed to light containing image information emitted from an irradiator such as a slit irradiator or a laser beam scanning irradiator. Thus, an electrostatic latent image is formed on the peripheral surface of the photoreceptor 801. The electrostatic latent image is developed into a toner image with a toner 804 in the developing device 803. The toner image is transferred from the photoreceptor 801 onto a recording medium which has been fed from a paper feed part to between the photoreceptor 801 and a transfer device in synchronization with a rotation of the photoreceptor 801. The recording medium having the toner image thereon is separated from the peripheral surface of the photoreceptor 801 and introduced into a fixing device. The recording medium having the fixed toner image thereon is discharged from the image forming apparatus as a copy. The cleaner 806 removes residual toner particles remaining on the peripheral surface of the photoreceptor 801 without being transferred. The cleaned photoreceptor 801 is neutralized to be ready for a next image forming operation.

Figure 8:
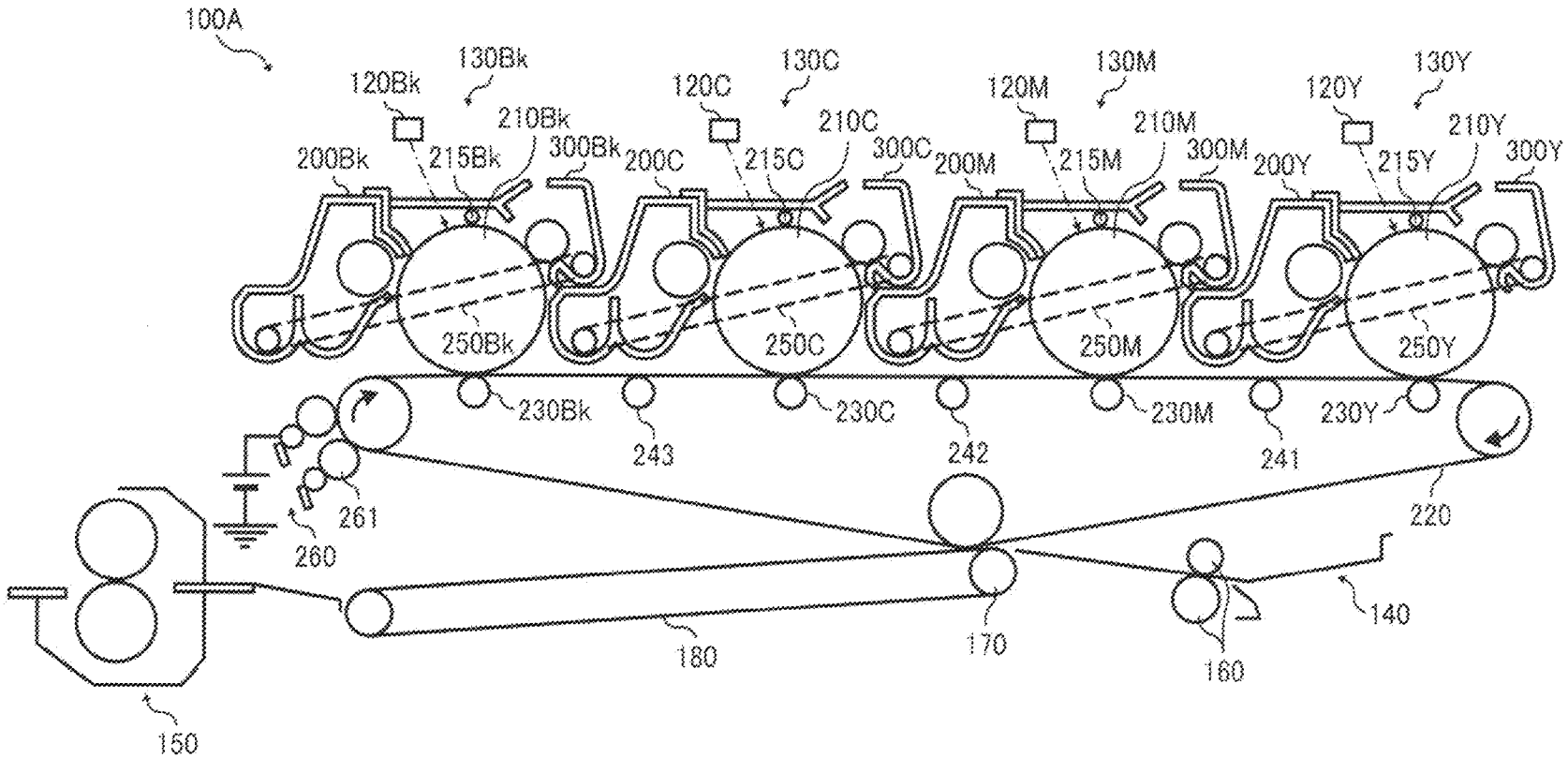
FIG. 8 and FIG. 9 are schematic views of image forming apparatuses according to some embodiments.
Figure 9:
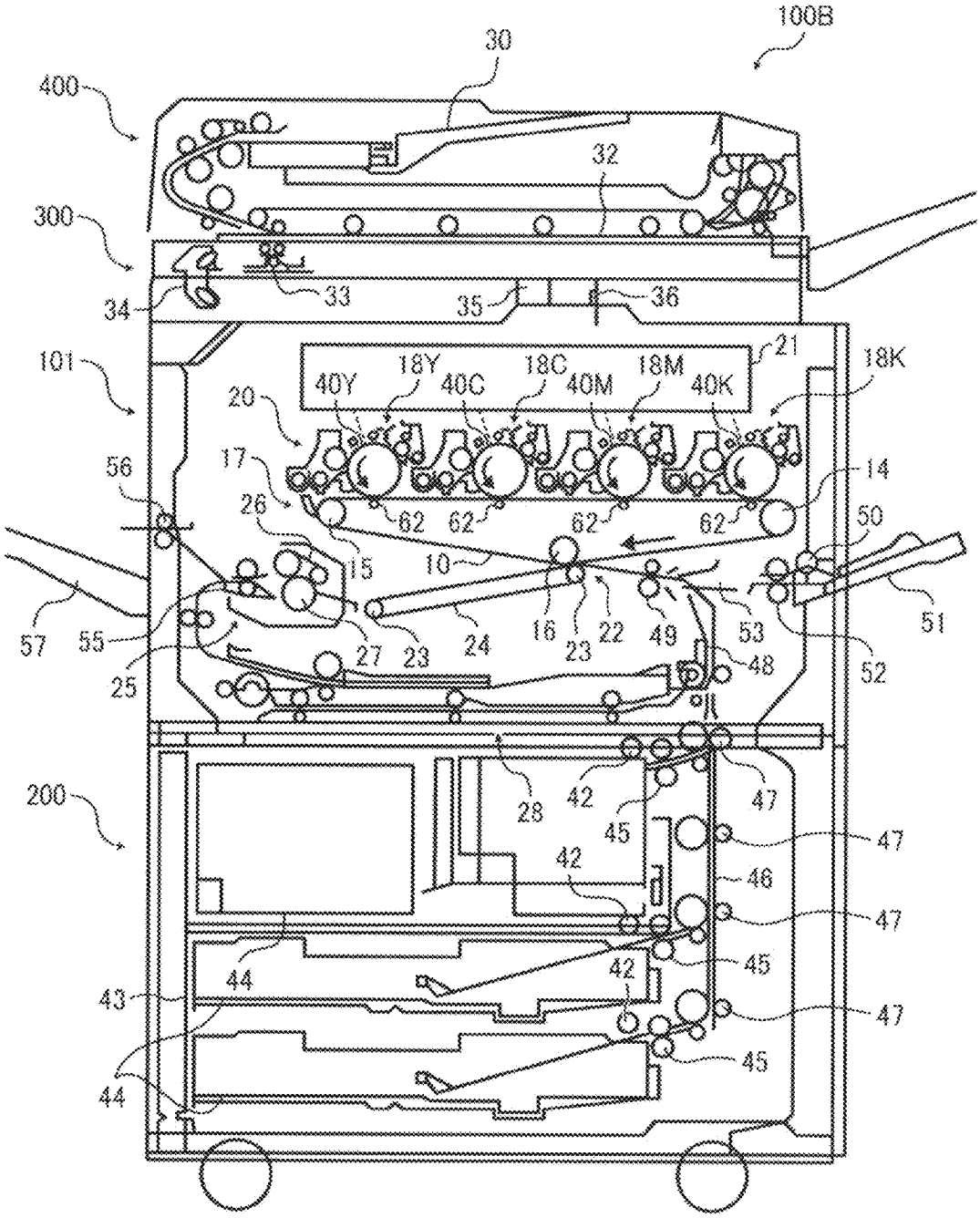

FIG. 8 and FIG. 9 are schematic views of image forming apparatuses according to some embodiments. In FIG. 8, an image forming apparatus 100A includes image writing parts 120Bk, 120C, 120M, and 120Y, image forming parts 130Bk, 130C, 130M, and 130Y, and a paper feed part 140. An image processing part converts image information into signals of black, cyan, magenta, and yellow and transmits them to the respective image writing parts 120Bk, 120C, 120M, and 120Y. Each of the image writing parts 120Bk, 120C, 120M, and 120Y is formed of a laser scanning optical system comprised of a deflector, such as a laser light source or a rotary polygon minor, a scanning imaging optical system, and a group of mirrors. Each of image writing parts 120Bk, 120C, 120M, and 120Y has an optical path for writing an image in the respective image forming parts 130Bk, 130C, 130M, and 130Y.

The image forming parts 130Bk, 130C, 130M, and 130Y include respective photoreceptors 210Bk, 210C, 210M, and 210Y, each of which may be comprised of an organic photoconductor. Around the photoreceptors 210Bk, 210C, 210M, and 210Y, chargers 215Bk, 215C, 215M, and 215Y, irradiation parts irradiated with laser light beams emitted from image writing parts 120Bk, 120C, 120M, and 120Y, developing devices 200Bk, 200C, 200M, and 200Y, primary transfer devices 230Bk, 230C, 230M, and 230Y, cleaners 300Bk, 300C, 300M, and 300Y, and neutralizers are disposed, respectively. The developing devices 200Bk, 200C, 200M, and 200Y each employ a two-component magnetic brush developing method. An intermediate transfer belt 220 is disposed between the series of the photoreceptors 210Bk, 210C, 210M, and 210Y and the series of the primary transfer devices 230Bk, 230C, 230M, and 230Y Toner images are transferred from the photoreceptors 210Bk, 210C, 210M, and 210Y onto the intermediate transfer belt 220 and superimposed on one another.

In some embodiments, a pre-transfer charger is disposed facing an outer surface of the intermediate transfer belt 220 downstream from the most downstream primary transfer position and upstream from the secondary transfer position. The pre-transfer charger is adapted to uniformly charge toner images having been transferred onto the intermediate transfer belt 220 in the primary transfer positions before the toner images are transferred onto a recording medium.

It is possible that the toner images transferred from the photoreceptors 210Bk, 210C, 210M, and 210Y onto the intermediate transfer belt 220 include a halftone portion, a solid portion, and a portion in which multiple-color toner images are overlapped, each of which having different charge amount. It is also possible that the toner images on the intermediate transfer belt 220 have variations in charge amount due to electric discharge occurred in the gaps formed at a downstream side from each primary transfer position. Such variations in charge amount reduce transfer efficiency in the secondary transfer position in which toner images are transferred from the intermediate transfer belt 220 onto a recording medium. The pre-transfer charger uniformly charges toner images transferred on the intermediate transfer belt 220 so as to improve transfer efficiency in the secondary transfer position.

By uniformly charging toner images having been transferred from the photoreceptors 210Bk, 210C, 210M, and 210Y onto the intermediate transfer belt 220 by the pre-transfer charger, the toner images can be efficiently and reliably transferred onto a recording medium even when the toner images have variation in charge amount.

Charge form the pre-transfer charger varies depending on the movement speed of the intermediate transfer belt 220. The smaller the movement speed of the intermediate transfer belt 220, the greater the charge amount of toner images on the intermediate transfer belt 220. This is because the toner images are exposed to the pre-transfer charger for a longer period of time as the movement speed of the intermediate transfer belt 220 gets slower. By contrast, the greater the movement speed of the intermediate transfer belt 220, the smaller the charge amount of toner images on the intermediate transfer belt 220. When the movement speed of the intermediate transfer belt 220 is variable during exposure of toner images to the pre-transfer charger, the pre-transfer charger is controlled so that the toner images have a constant charge regardless of the movement speed of the intermediate transfer belt 220.

Conductive rollers 241, 242, and 243 are disposed between adjacent primary transfer devices 230Bk, 230C, 230M, and 230Y. A sheet of transfer paper (hereinafter "transfer paper") is fed from the paper feed part 140 onto a secondary transfer belt 180 via a pair of registration rollers 160. The secondary transfer roller 170 transfers the toner image from the intermediate transfer belt 220 onto the transfer paper at a position where the intermediate transfer belt 220 is contacting the secondary transfer belt 180.

The secondary transfer belt 180 conveys the transfer paper having the toner image thereon to a fixing device 150. The toner image is fixed on the transfer paper in the fixing device 150. On the other hand, an intermediate transfer belt cleaner 260 removes residual toner particles remaining on the intermediate transfer belt 220 without being transferred onto the transfer paper.

The toner image on the intermediate transfer belt 220 has a negative polarity before being transferred onto the transfer paper. The secondary transfer roller 170 is applied with a positive voltage to cause transfer of the toner image onto the transfer paper. Residual toner particles remaining on the intermediate transfer belt 220 are charged to a positive polarity due to electric discharge occurred at the instant the transfer paper separates from the intermediate transfer belt 220. When paper jam is occurring or toner image is formed on non-image portions, toner particles are kept negatively charged without being positively charged by the secondary transfer roller 170.

In the present embodiment, each of the photoreceptors has a photosensitive layer having a thickness of 30 μm. The beam spot diameter of the optical system is 50×60 μm, and the light quantity is 0.47 mW. In the developing process, the potentials of non-irradiated and irradiated portions of the photoreceptor 210Bk are −700 V and −120 V, respectively, the developing bias voltage is −470 V, and the developing potential is 350 V. A black toner image formed on the photoreceptor 210Bk is transferred onto a transfer paper via the intermediate transfer belt 220 and finally fixed on the transfer paper. In the transfer process, each of the primary transfer devices 230Bk, 230C, 230M, and 230Y transfers respective toner images of black, cyan, magenta, and yellow onto the intermediate transfer belt 220 to form a composite toner image and the secondary transfer roller 170 transfers the composite toner image onto the transfer paper.

Referring to FIG. 8, the developing devices 200Bk, 200C, 200M, and 200Y are connected to the respective cleaners 300Bk, 300C, 300M, and 300Y with respective toner transfer tubes 250Bk, 250C, 250M, and 250Y indicated by dotted lines in FIG. 8. Each of the toner transfer tubes 250Bk, 250C, 250M, and 250Y has an internal screw for transferring toner particles collected in the respective cleaners 300Bk, 300C, 300M, and 300Y to the respective developing devices 200Bk, 200C, 200M, and 200Y.

Generally, in a direct transfer method in which toner images are directly transferred from four photoreceptors onto transfer paper conveyed by a belt conveyer, the photoreceptors are brought into direct contact with the transfer paper. In this method, toner particles collected from the photoreceptors cannot be recycled because of including an amount of paper powder, which may produce defective images. In another transfer method in which toner images are transferred from a single photoreceptor onto an intermediate transfer member, toner particles collected from the photoreceptor cannot be recycled because of including various color toner particles, which is difficult to separate into each color toner particles. There has been a proposal to use mixture toner as a black toner. However, mixture toner does not always express black color and the expressed color varies depending on printing mode. Therefore, it is impossible for a single photoreceptor to recycle mixture toner.

Unlike the above-described two methods, in the present embodiment employing the intermediate transfer belt 220 and four photoreceptors 210Bk, 210C, 210M, and 210Y, toner particles respectively collected by the cleaners 300Bk, 300C, 300M, and 300Y can be recycled because of including no paper powder.

Positively-charged toner particles remaining on the intermediate transfer belt 220 are removed by a conductive fur brush 262 to which a negative voltage is supplied. Another conductive fur brush 261 is supplied with a positive voltage. Most residual toner particles are removed by the conductive fur brushes 261 and 262. Residual toner particles, paper powder, talc, etc., which have not been removed by the conductive fur brush 261 are negatively charged by the conductive fur brush 262. The negatively charged residual toner particles are then conveyed to the primary transfer position facing the black photoreceptor 210Bk as the intermediate transfer belt 220 rotates, but are prevented from transferring onto the black photoreceptor 210Bk due to its polarity.

The intermediate transfer belt 220 is comprised of a resin layer and optional elastic and/or surface layers.

Specific examples of usable resins for the resin layer include, but are not limited to, polycarbonate; fluorine-containing resins (e.g., ETFE, PVDF); styrene-based resins (i.e., homopolymers and copolymers of styrene and/or styrene substitutes) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer, styrene-phenyl acrylate copolymer), styrene-methacrylate copolymers (e.g., styrene-methyl methacrylate copolymer, styrene-ethyl methacrylate copolymer, styrene-phenyl methacrylate copolymer), styrene-methyl α-chloromethacrylate copolymer, and styrene-acrylonitrile-acrylate copolymer; methyl methacrylate resin, butyl methacrylate resin, ethyl acrylate resin, butyl acrylate resin, modified acrylic resins (e.g., silicone-modified acrylic resin, vinyl-chloride-resin-modified acrylic resin, acrylic-urethane resin), vinyl chloride resin, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin. Two or more of these resins can be used in combination.

Specific examples of usable elastic materials (elastic rubbers and elastomers) for the elastic layer include, but are not limited to, butyl rubber, fluorine-containing rubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfide rubber, polynorbornene rubber, hydrogenated nitrile rubber, and thermoplastic elastomers (e.g., polystyrene type, polyolefin type, polyvinyl chloride type, polyurethane type, polyamide type, polyurea type, polyester type, fluorine resin type). Two or more of these materials can be used in combination.

Materials usable for the surface layer are required to reduce adhesive force of toner to the intermediate transfer belt so as to improve secondary transfer efficiency. Such a material can be prepared by dispersing one or more kinds of powdery or particulate materials (e.g., fluorine-containing resin, fluorine-containing compound, fluorinated carbon, titanium dioxide, silicon carbide), which may have different particle diameters from each other, in one more kinds of resins (e.g., polyurethane, polyester, epoxy resin). Alternatively, the surface layer may be a fluorine-rich layer prepared by thermally treating a fluorine rubber at the surface so as to reduce surface energy.

The resin and/or elastic layers may include a conductive agent for controlling resistivity. Specific examples of usable conductive agents include, but are not limited to, carbon black, graphite, metal powders such as aluminum and nickel, and conductive metal oxides (e.g., tin oxide, titanium oxide, antimony oxide, indium oxide, potassium titanate, antimony-tin complex oxide (ATO), indium-tin complex oxide (ITO)) which may be covered with insulating fine particles of barium sulfate, magnesium silicate, calcium carbonate, etc.

FIG. 9 is a schematic view of another image forming apparatus according to an embodiment. An image forming apparatus 100B employs a tandem-type indirect transfer method. The image forming apparatus 100B includes a main body 101, a paper feed table 200 disposed below the main body 101, a scanner 300 disposed above the main body 101, and an automatic document feeder (ADF) 400 disposed above the scanner 300. A seamless-belt intermediate transfer member 10 is disposed at the center of the main body 101.

The intermediate transfer member 10 is stretched across support rollers 14, 15, and 16 and is rotatable clockwise in FIG. 9. An intermediate transfer member cleaner 17 for removing residual toner particles remaining on the intermediate transfer member 10 is disposed on the left side of the support roller 15 in FIG. 9. Image forming units 118Y, 18C, 18M, and 18K for producing respective images of yellow, cyan, magenta, and black are disposed along a stretched surface of the intermediate transfer member 10 between the support rollers 14 and 15, thus forming a tandem image forming part 20.

An irradiator 21 is disposed immediately above the tandem image forming part 20. A secondary transfer device 22 is disposed on the opposite side of the tandem image forming part 20 relative to the intermediate transfer member 10. The secondary transfer device 22 includes a seamless secondary transfer belt 24 stretched between two rollers 23. The secondary transfer belt 24 is pressed against the support roller 16 with the intermediate transfer member 10 therebetween so that an image can be transferred from the intermediate transfer member 10 onto a sheet of a recording medium. A fixing device 25 for fixing a toner image on the sheet is disposed adjacent to the secondary transfer device 22. The fixing device 25 includes a seamless fixing belt 26 and a pressing roller 27 pressed against the fixing belt 26. The secondary transfer device 22 has a function of conveying the sheet having the toner image thereon to the fixing device 25. In another embodiment, the secondary transfer device 22 may be comprised of, for example, a transfer roller or a non-contact charger without sheet conveying function. A sheet reversing device 28 for reversing a sheet upside down is disposed below the secondary transfer device 22 and the fixing device 25 and in parallel with the tandem image forming part 20.

To make a copy, a document is set on a document table 30 of the automatic document feeder 400. Alternatively, a document is set on a contact glass 32 of the scanner 300 while the automatic document feeder 400 is lifted up and then the automatic document feeder 400 is held down.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. Thus, the document is read.

On the other hand, upon pressing of the switch, one of the support rollers 14, 15, and 16 is driven to rotate by a driving motor and the other two support rollers are driven to rotate by rotation of the rotating support roller. Thus, the intermediate transfer member 10 is rotated and conveyed. In the image forming units 18Y, 18C, 18M, and 18K, single-color toner images of yellow, cyan, magenta, and black are formed on photoreceptors 40Y, 40C, 40M, and 40K, respectively. The single-color toner images are sequentially transferred onto the intermediate transfer member 10 along conveyance of the intermediate transfer member 10 to form a composite full-color toner image thereon.

On the other hand, upon pressing of the switch, one of paper feed rollers 42 starts rotating in the paper feed table 200 so that a sheet of a recording paper is fed from one of paper feed cassettes 44 in a paper bank 43. The sheet is separated by one of separation rollers 45 and fed to a paper feed path 46. Feed rollers 47 feed the sheet to a paper feed path 48 in the main body 101. The sheet is stopped by a registration roller 49.

Alternatively, a recording paper may be fed from a manual feed tray 51 by rotating a feed roller 50, separated by a separation roller 52, fed to a manual paper feed path 53, and stopped by the registration roller 49.

The registration roller 49 feeds the sheet to between the intermediate transfer member 10 and the secondary transfer device 22 in synchronization with an entry of the composite full-color toner image formed on the intermediate transfer member 10.

The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56.

On the other hand, the intermediate transfer member cleaner 17 removes residual toner particles remaining on the intermediate transfer member 10 without being transferred. Thus, the tandem image forming part 20 gets ready for next image formation. Although the registration roller 49 is generally grounded, the registration roller 49 is applicable with a bias for the purpose of removing paper powders from the sheet.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Measurement of Compatibility

Compatibility of a fine resin particles with a binder resin is measured by instruments TA-60WS and DSC-60 from Shimadzu Corporation. When the peak area of an endothermic peak of the fine resin particle observed in a DSC curve obtained in the second heating is half or less that observed in a DSC curve obtained in the first heating, the fine resin particle is regarded as being compatible with the binder resin.

Measurement of Volume Average Particle Diameter

Volume average particle diameter (Dv) and number average particle diameter (Dn) of toners are measured by a particle size analyzer MULTISIZER III (from Beckman Coulter, Inc.) having an aperture size of 100 μm and an analysis software program Beckman Coulter Multisizer 3 Version 3.51 as follows. First, charge a 100-ml glass beaker with 0.5 ml of a 10% surfactant (an alkylbenzene sulfonate NEOGEN SC-A from Dai-ichi Kogyo Seiyaku Co., Ltd.). Add 0.5 g of a sample to the beaker and mix with a micro spatula. Further add 80 ml of ion-exchange water to the beaker. Subject the resulting dispersion to a dispersion treatment for 10 minutes using an ultrasonic disperser (W-113MK-II from Honda Electronics). Subject the dispersion to a measurement by the MULTISIZER III using a measuring solution ISOTON III (from Beckman Coulter, Inc.). During the measurement, the amount of the dispersion is controlled so that the sample concentration is within 8±2%. In terms of measurement reproducibility, it is important to keep the sample concentration within 8±2% so as not to cause measurement error.

Example 1

Preparation of Unmodified Polyester (Low-Molecular-Weight Polyester)

A reaction vessel equipped with a condenser, a stirrer, and a nitrogen inlet pipe is charged with 61 parts of ethylene oxide adduct of bisphenol A, 12 parts of propylene oxide adduct of bisphenol A, 23 parts of isophthalic acid, 4 parts of adipic acid, and 2 parts of dibutyltin oxide. The mixture is subjected to a reaction for 8 hours at 220° C. under normal pressures. The mixture is further subjected to a reaction for 5 hours under reduced pressures of 10 to 15 mmHg. Thus, a polyester resin a1 that is an unmodified polyester resin is prepared.

The polyester resin a1 has a weight average molecular weight (Mw) of 5,500, a glass transition temperature (Tg) of 48.0° C., a flow beginning temperature (Tfb) of 64.1° C., and a ½ method temperature (T½) of 73.6° C.

Preparation of Master Batch

First, 1,000 parts of water, 540 parts of a carbon black (PRINTEX 35 from Degussa) having a DBP oil absorption of 42 ml/100 g and a pH of 9.5, and 1,200 parts of the unmodified polyester resin are mixed by a HENSCHEL MIXER (from Mitsui Mining and Smelting Co., Ltd.). The resulting mixture is kneaded for 30 minutes at 150° C. using double rolls, the kneaded mixture is then rolled and cooled, and the rolled mixture is then pulverized into particles by a pulverizer (from Hosokawa Micron Corporation). Thus, a master batch is prepared.

Preparation of Solution or Dispersion of Toner Constituents

In a beaker, 100 parts of the polyester resin a1 are dissolved in 130 parts of ethyl acetate. Further, 10 parts of a carnauba wax (having a molecular weight of 1,800, an acid value of 2.5, and a penetration of 1.5 mm (at 40° C.)) and 10 parts of the master batch are added to the beaker. The resulting mixture is subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a solution or dispersion of toner constituents is prepared.

Preparation of Styrene-Acrylic Resin Particles

A reaction vessel equipped with a stirrer and a thermometer is charged with 683 parts of water, 16 parts of a sodium salt of a sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 part of ammonium persulfate. The mixture is agitated for 15 minutes at a revolution of 400 rpm, thus preparing a white emulsion. The white emulsion is heated to 75° C. and subjected to a reaction for 5 hours. A 1% aqueous solution of ammonium persulfate in an amount of 30 parts is further added to the emulsion, and the mixture is aged for 5 hours at 75° C. Thus, an aqueous dispersion of styrene-acrylic resin particles A1, which are particles of a vinyl resin (i.e., a copolymer of styrene, methacrylic acid, butyl acrylate, and a sodium salt of a sulfate of ethylene oxide adduct of methacrylic acid), is prepared. The styrene-acrylic resin particles A1 have a volume average particle diameter of 14 nm measured by a laser diffraction particle size distribution analyzer LA-920 (from Horiba, Ltd.), a weight average molecular weight (Mw) of 420,000, a glass transition temperature (Tg) of 62.9° C., a flow beginning temperature (Tfb) of 136.4° C., and a ½ method temperature (T½) of 174.0° C.

Preparation of Acrylic Resin Particles

A reaction vessel equipped with a stirrer and a thermometer is charged with 683 parts of water, 10 parts of distearyl dimethyl ammonium chloride (CATION DS from Kao Corporation), 144 parts of methyl methacrylate, 50 parts of butyl acrylate, 1 part of ammonium persulfate, and 2 parts of ethylene glycol dimethacrylate. The mixture is agitated for 15 minutes at a revolution of 400 rpm, thus preparing a white emulsion. The white emulsion is heated to 65° C. and subjected to a reaction for 10 hours. A 1% aqueous solution of ammonium persulfate in an amount of 30 parts is further added to the emulsion, and the mixture is aged for 5 hours at 75° C. Thus, an aqueous dispersion of acrylic resin particles B1, which are particles of a methyl-methacrylate-based vinyl resin, is prepared. The acrylic resin particles B1 have a volume average particle diameter of 35 nm measured by a laser diffraction particle size distribution analyzer LA-920 (from Horiba, Ltd.), a weight average molecular weight (Mw) of 31,000, a glass transition temperature (Tg) of 79.8° C., a flow beginning temperature (Tfb) of 122.2° C., and a ½ method temperature (T½) of 150.1° C.

The above procedure for preparing the dispersion of the acrylic resin particles B1 is repeated except for changing the amount of ethylene glycol dimethacrylate from 2 parts to 1 part and 4 parts to prepare dispersions of acrylic resin particles B2 and B3, respectively. The above procedure for preparing the dispersion of the acrylic resin particles B1 is repeated except for changing the amount of ethylene glycol dimethacrylate from 2 parts to 0 part to prepare a dispersion of acrylic resin particles B4.

Evaluation of Swelling Property

Each of the dispersions of resin particles is contained in a 30-ml screw vial (from AS ONE Corporation) with a measuring pipette so that the height from the bottom gets 20 mm. After further adding 10 ml of ethyl acetate with a measuring pipette, the vial is left for 24 hours so that the mixture is separated into a lower white resin emulsion phase and an upper ethyl acetate phase. Swelling property is evaluated by the height of the lower white resin emulsion phase from the bottom of the vial. The higher the swelling property, the greater the height of the lower white resin emulsion phase. Swelling property is graded into the following four ranks in terms of the height of the lower white resin emulsion phase. Resin particles in the ranks A, B, and C have swelling property.

A: The height is not less than 25 mm. Swells sufficiently.

B: The height is not less than 21 mm and less than 25 mm. Swells well.

C: The height is not less than 20 mm and less than 21 mm. Swells insufficiently.

D: The height is less than 20 mm. Not swell.

Evaluation results for the resin particles are shown in Table 1.

TABLE 1

| | Swelling Property | Compatibility with Binder Resin | Volume Average Particle Diameter |
|---|---|---|---|
| Resin Particles A1 | B | Incompatible | 14 nm |
| Resin Particles B1 | B | Incompatible | 35 nm |
| Resin Particles B2 | A | Incompatible | 42 nm |
| Resin Particles B3 | C | Incompatible | 108 nm |
| Resin Particles B4 | A | Incompatible | 193 nm |

Preparation of Toner a1

Preparation of Aqueous Medium

First, 660 parts of water, 25 parts of the dispersion of the styrene-acrylic resin particles A1, 25 parts of a 48.5% aqueous solution of dodecyl diphenyl ether sodium disulfonate (ELEMINOL MON-7 from Sanyo Chemical Industries, Ltd.), and 60 parts of ethyl acetate are mixed. Further, 50 parts of the dispersion the acrylic resin particles B1 are added to the mixture. Thus, an aqueous medium is obtained. Aggregations having a size of several hundred μm are observed in the aqueous medium by an optical microscope. The aqueous medium is agitated by a TK HOMOMIXER (from Primix Corporation) at a revolution of 8,000 rpm. As a result, it is observed by an optical microscope that the aggregations are loosened into small aggregations having several μm. Thus, it is expected that the acrylic resin particles B1 can uniformly adhere to liquid droplets of the solution or dispersion of toner constituents in a subsequent emulsification process because the aggregations have been loosened.

Preparation of Emulsion Slurry

While agitating 150 parts of the aqueous medium in a vessel at a revolution of 12,000 rpm by a TK HOMOMIXER (from PRIMIX Corporation), 100 parts of the solution or dispersion of toner constituents are mixed therein for 10 minutes. Thus, an emulsion slurry is prepared.

Removal of Organic Solvents

A flask equipped with a degassing tube, a stirrer, and a thermometer is charged with 100 parts of the emulsion slurry. The emulsion slurry is agitated at a peripheral speed of 20 m/min for 12 hours at 30° C. under reduced pressures so that the organic solvents are removed therefrom. Thus, a dispersion slurry is prepared.

Washing

Total amount of the dispersion slurry is filtered under reduced pressures. A residue cake is mixed with and redispersed in 300 parts of ion-exchange water by a TK HOMOMIXER at a revolution of 12,000 rpm for 10 minutes, followed by filtering. Another residue cake thus obtained is mixed with 300 parts of ion-exchange water by a TK HOMOMIXER at a revolution of 12,000 rpm for 10 minutes, followed by filtering. This operation is repeated three times, thus obtaining a washed slurry having a conductivity within a range of 0.1 to 10 μS/cm.

Heating Treatment

In a flask equipped with a stirrer and a thermometer, the washed slurry is agitated at a peripheral speed of 20 m/min at 50° C. for 60 minutes so that the acrylic resin particles B1 are fixed on the surfaces of the toner particles, followed by filtering.

Drying

The heated cake is dried by a drier for 48 hours at 45° C. and filtered with a mesh having openings of 75 μm. Thus, a mother toner a1 is prepared.

External Treatment

The mother toner a1 in an amount of 100 parts is mixed with 0.6 parts of a hydrophobized silica having an average particle diameter of 100 nm, 1.0 part of a titanium oxide having an average particle diameter of 20 nm, and 0.8 parts of a hydrophobized silica having an average particle diameter of 15 nm by a HENSCHEL MIXER. Thus, a toner a1 is prepared.

Example 2

Preparation of Polyester Resin b1

A reaction vessel equipped with a condenser, a stirrer, and a nitrogen inlet pipe is charged with 61 parts of ethylene oxide adduct of bisphenol A, 12 parts of propylene oxide adduct of bisphenol A, 4 parts of isophthalic acid, 23 parts of adipic acid, and 2 parts of dibutyltin oxide. The mixture is subjected to a reaction for 8 hours at 220° C. under normal pressures. The mixture is further subjected to a reaction for 8 hours under reduced pressures of 10 to 15 mmHg. Thus, a polyester resin b1 that is an unmodified polyester resin is prepared.

Preparation of Toner b1

The procedure for preparing the toner a1 in Example 1 is repeated except for replacing the polyester resin a1 with the polyester resin b1. Thus, a toner b1 is prepared.

Example 3

Preparation of Polyester Resin c1

A reaction vessel equipped with a condenser, a stirrer, and a nitrogen inlet pipe is charged with 61 parts of ethylene oxide adduct of bisphenol A, 12 parts of propylene oxide adduct of bisphenol A, 20 parts of isophthalic acid, 7 parts of adipic acid, and 2 parts of dibutyltin oxide. The mixture is subjected to a reaction for 8 hours at 220° C. under normal pressures. The mixture is further subjected to a reaction for 5 hours under reduced pressures of 10 to 15 mmHg. Thus, a polyester resin c1 that is an unmodified polyester resin is prepared.

Preparation of Toner c1

The procedure for preparing the toner a1 in Example 1 is repeated except for replacing the polyester resin a1 with the polyester resin c1. Thus, a toner c1 is prepared.

Example 4

Preparation of Polyester Resin d1

A reaction vessel equipped with a condenser, a stirrer, and a nitrogen inlet pipe is charged with 61 parts of ethylene oxide adduct of bisphenol A, 12 parts of propylene oxide adduct of bisphenol A, 20 parts of isophthalic acid, 7 parts of adipic acid, and 2 parts of dibutyltin oxide. The mixture is subjected to a reaction for 5 hours at 220° C. under normal pressures. The mixture is further subjected to a reaction for 5 hours under reduced pressures of 10 to 15 mmHg. Thus, a polyester resin d1 that is an unmodified polyester resin is prepared.

Preparation of Toner d1

The procedure for preparing the toner a1 in Example 1 is repeated except for replacing the polyester resin a1 with the polyester resin d1. Thus, a toner d1 is prepared.

Example 5

Preparation of Polyester Resin e1

A reaction vessel equipped with a condenser, a stirrer, and a nitrogen inlet pipe is charged with 61 parts of ethylene oxide adduct of bisphenol A, 12 parts of propylene oxide adduct of bisphenol A, 26 parts of isophthalic acid, 1 part of adipic acid, and 2 parts of dibutyltin oxide. The mixture is subjected to a reaction for 8 hours at 220° C. under normal pressures. The mixture is further subjected to a reaction for 5 hours under reduced pressures of 10 to 15 mmHg. Thus, a polyester resin e1 that is an unmodified polyester resin is prepared.

Preparation of Toner e1

The procedure for preparing the toner a1 in Example 1 is repeated except for replacing the polyester resin a1 with the polyester resin e1. Thus, a toner e1 is prepared.

Example 6

Preparation of Polyester Resin f1

A reaction vessel equipped with a condenser, a stirrer, and a nitrogen inlet pipe is charged with 65 parts of ethylene oxide adduct of bisphenol A, 13 parts of propylene oxide adduct of bisphenol A, 15 parts of isophthalic acid, 7 parts of adipic acid, and 2 parts of dibutyltin oxide. The mixture is subjected to a reaction for 5 hours at 220° C. under normal pressures. The mixture is further subjected to a reaction for 3 hours under reduced pressures of 10 to 15 mmHg. Thus, a polyester resin f1 that is an unmodified polyester resin is prepared.

Preparation of Toner f1

The procedure for preparing the toner a1 in Example 1 is repeated except for replacing the polyester resin a1 with the polyester resin f1. Thus, a toner f1 is prepared.

Example 7

Preparation of Polyester Resin g1

A reaction vessel equipped with a condenser, a stirrer, and a nitrogen inlet pipe is charged with 51 parts of ethylene oxide adduct of bisphenol A, 6 parts of propylene oxide adduct of bisphenol A, 31 parts of isophthalic acid, 12 parts of adipic acid, and 2 parts of dibutyltin oxide. The mixture is subjected to a reaction for 5 hours at 220° C. under normal pressures. The mixture is further subjected to a reaction for 3 hours under reduced pressures of 10 to 15 mmHg. Thus, a polyester resin g1 that is an unmodified polyester resin is prepared.

Preparation of Toner g1

The procedure for preparing the toner a1 in Example 1 is repeated except for replacing the polyester resin a1 with the polyester resin g1. Thus, a toner g1 is prepared.

Example 8

Preparation of Toner h1

The procedure for preparing the toner a1 in Example 1 is repeated except that the monomer composition for the styrene-acrylic resin particles A1 is changed so that resulting styrene-acrylic resin particles H1 have a T½ of 142.6° C. Thus, a toner h1 is prepared.

Example 9

Preparation of Toner i1

The procedure for preparing the toner a1 in Example 1 is repeated except that the monomer composition for the styrene-acrylic resin particles A1 is changed so that resulting styrene-acrylic resin particles I1 have a T½ of 187.3° C. Thus, a toner it is prepared.

Example 10

Preparation of Toner j1

The procedure for preparing the toner a1 in Example 1 is repeated except that the monomer composition for the styrene-acrylic resin particles A1 is changed so that resulting styrene-acrylic resin particles J1 have a Tg of 45.0° C. Thus, a toner j1 is prepared.

Example 11

Preparation of Toner k1

The procedure for preparing the toner a1 in Example 1 is repeated except that the monomer composition for the styrene-acrylic resin particles A1 is changed so that resulting styrene-acrylic resin particles K1 have a Tg of 64.9° C. Thus, a toner k1 is prepared.

Example 12

Preparation of Toner l1

The procedure for preparing the toner a1 in Example 1 is repeated except that the monomer composition for the styrene-acrylic resin particles A1 is changed so that resulting styrene-acrylic resin particles L1 have a weight average molecular weight (Mw) of 40,000. Thus, a toner l1 is prepared.

Example 13

Preparation of Toner m1

The procedure for preparing the toner a1 in Example 1 is repeated except that the monomer composition for the styrene-acrylic resin particles A1 is changed so that resulting styrene-acrylic resin particles M1 have a weight average molecular weight (Mw) of 500,000. Thus, a toner m1 is prepared.

Example 14

Preparation of Toner n1

The procedure for preparing the toner a1 in Example 1 is repeated except that the monomer composition for the acrylic resin particles B1 is changed so that resulting acrylic resin particles N1 have a T½ of 130.2° C. Thus, a toner n1 is prepared.

Example 15

Preparation of Toner o1

The procedure for preparing the toner a1 in Example 1 is repeated except that the monomer composition for the acrylic resin particles B1 is changed so that resulting acrylic resin particles O1 have a T½ of 179.7° C. Thus, a toner o1 is prepared.

Example 16

Preparation of Toner p1

The procedure for preparing the toner a1 in Example 1 is repeated except that the monomer composition for the acrylic resin particles B1 is changed so that resulting acrylic resin particles P1 have a Tg of 60.1° C. Thus, a toner p1 is prepared.

Example 17

Preparation of Toner q1

The procedure for preparing the toner a1 in Example 1 is repeated except that the monomer composition for the acrylic resin particles B1 is changed so that resulting acrylic resin particles Q1 have a Tg of 90.0° C. Thus, a toner q1 is prepared.

Example 18

Preparation of Toner r1

The procedure for preparing the toner a1 in Example 1 is repeated except that the monomer composition for the acrylic resin particles B1 is changed so that resulting acrylic resin particles R1 have a weight average molecular weight (Mw) of 30,000. Thus, a toner r1 is prepared.

Comparative Example 1

Preparation of Polyester Resin a2

A reaction vessel equipped with a condenser, a stirrer, and a nitrogen inlet pipe is charged with 61 parts of ethylene oxide adduct of bisphenol A, 12 parts of propylene oxide adduct of bisphenol A, 0 part of isophthalic acid, 27 parts of adipic acid, and 2 parts of dibutyltin oxide. The mixture is subjected to a reaction for 5 hours at 220° C. under normal pressures. The mixture is further subjected to a reaction for 5 hours under reduced pressures of 10 to 15 mmHg. Thus, a polyester resin a2 that is an unmodified polyester resin is prepared.

Preparation of Toner a2

The procedure for preparing the toner a1 in Example 1 is repeated except for replacing the polyester resin a1 with the polyester resin a2. Thus, a toner a2 is prepared.

Comparative Example 2

Preparation of Polyester Resin b2

A reaction vessel equipped with a condenser, a stirrer, and a nitrogen inlet pipe is charged with 61 parts of ethylene oxide adduct of bisphenol A, 12 parts of propylene oxide adduct of bisphenol A, 27 parts of isophthalic acid, 0 part of adipic acid, and 2 parts of dibutyltin oxide. The mixture is subjected to a reaction for 4 hours at 220° C. under normal pressures. The mixture is further subjected to a reaction for 5 hours under reduced pressures of 10 to 15 mmHg. Thus, a polyester resin b2 that is an unmodified polyester resin is prepared.

Preparation of Toner b2

The procedure for preparing the toner a1 in Example 1 is repeated except for replacing the polyester resin a1 with the polyester resin b2. Thus, a toner b2 is prepared.

Comparative Example 3

Preparation of Polyester Resin c2

A reaction vessel equipped with a condenser, a stirrer, and a nitrogen inlet pipe is charged with 61 parts of ethylene oxide adduct of bisphenol A, 12 parts of propylene oxide adduct of bisphenol A, 13 parts of isophthalic acid, 14 parts of adipic acid, and 2 parts of dibutyltin oxide. The mixture is subjected to a reaction for 8 hours at 220° C. under normal pressures. The mixture is further subjected to a reaction for 5 hours under reduced pressures of 10 to 15 mmHg. Thus, a polyester resin c2 that is an unmodified polyester resin is prepared.

Preparation of Toner c2

The procedure for preparing the toner a1 in Example 1 is repeated except for replacing the polyester resin a1 with the polyester resin c2. Thus, a toner c2 is prepared.

Comparative Example 4

Preparation of Polyester Resin d2

A reaction vessel equipped with a condenser, a stirrer, and a nitrogen inlet pipe is charged with 61 parts of ethylene oxide adduct of bisphenol A, 12 parts of propylene oxide adduct of bisphenol A, 27 parts of isophthalic acid, 0 part of adipic acid, and 2 parts of dibutyltin oxide. The mixture is subjected to a reaction for 14 hours at 220° C. under normal pressures. The mixture is further subjected to a reaction for 5 hours under reduced pressures of 10 to 15 mmHg. Thus, a polyester resin d2 that is an unmodified polyester resin is prepared.

Preparation of Toner d2

The procedure for preparing the toner a1 in Example 1 is repeated except for replacing the polyester resin a1 with the polyester resin d2. Thus, a toner d2 is prepared.

Comparative Example 5

Preparation of Polyester Resin e2

A reaction vessel equipped with a condenser, a stirrer, and a nitrogen inlet pipe is charged with 61 parts of ethylene oxide adduct of bisphenol A, 21 parts of propylene oxide adduct of bisphenol A, 23 parts of isophthalic acid, 4 parts of adipic acid, and 2 parts of dibutyltin oxide. The mixture is subjected to a reaction for 3 hours at 220° C. under normal pressures. The mixture is further subjected to a reaction for 3 hours under reduced pressures of 10 to 15 mmHg. Thus, a polyester resin e2 that is an unmodified polyester resin is prepared.

Preparation of Toner e2

The procedure for preparing the toner a1 in Example 1 is repeated except for replacing the polyester resin a1 with the polyester resin e2. Thus, a toner e2 is prepared.

Comparative Example 6

Preparation of Polyester Resin f2

A reaction vessel equipped with a condenser, a stirrer, and a nitrogen inlet pipe is charged with 43 parts of ethylene oxide adduct of bisphenol A, 4 parts of propylene oxide adduct of bisphenol A, 27 part of isophthalic acid, 22 parts of adipic acid, and 2 parts of dibutyltin oxide. The mixture is subjected to a reaction for 8 hours at 220° C. under normal pressures. The mixture is further subjected to a reaction for 8 hours under reduced pressures of 10 to 15 mmHg. Thus, a polyester resin f2 that is an unmodified polyester resin is prepared.

Preparation of Toner f2

The procedure for preparing the toner a1 in Example 1 is repeated except for replacing the polyester resin a1 with the polyester resin f2. Thus, a toner f2 is prepared.

Comparative Example 7

Preparation of Toner g2

The procedure for preparing the toner a1 in Example 1 is repeated except that the monomer composition for the styrene-acrylic resin particles A1 is changed so that resulting styrene-acrylic resin particles G2 have a T½ of 138.5° C. Thus, a toner g2 is prepared.

Comparative Example 8

Preparation of Toner h2

The procedure for preparing the toner a1 in Example 1 is repeated except that the monomer composition for the styrene-acrylic resin particles A1 is changed so that resulting styrene-acrylic resin particles H2 have a T½ of 190.6° C. Thus, a toner h1 is prepared.

Comparative Example 9

Preparation of Toner i2

The procedure for preparing the toner a1 in Example 1 is repeated except that the monomer composition for the styrene-acrylic resin particles A1 is changed so that resulting styrene-acrylic resin particles I2 have a Tg of 44.0° C. Thus, a toner i2 is prepared.

Comparative Example 10

Preparation of Toner j2

The procedure for preparing the toner a1 in Example 1 is repeated except that the monomer composition for the styrene-acrylic resin particles A1 is changed so that resulting styrene-acrylic resin particles J2 have a Tg of 66.4° C. Thus, a toner j2 is prepared.

Comparative Example 11

Preparation of Toner k2

The procedure for preparing the toner a1 in Example 1 is repeated except that the monomer composition for the styrene-acrylic resin particles A1 is changed so that resulting styrene-acrylic resin particles K2 have a weight average molecular weight (Mw) of 38,000. Thus, a toner k2 is prepared.

Comparative Example 12

Preparation of Toner l2

The procedure for preparing the toner a1 in Example 1 is repeated except that the monomer composition for the styrene-acrylic resin particles A1 is changed so that resulting styrene-acrylic resin particles L2 have a weight average molecular weight (Mw) of 520,000. Thus, a toner l2 is prepared.

Comparative Example 13

Preparation of Toner m2

The procedure for preparing the toner a1 in Example 1 is repeated except that the monomer composition for the acrylic resin particles B1 is changed so that resulting acrylic resin particles M2 have a T½ of 128.6° C. Thus, a toner m1 is prepared.

Comparative Example 14

Preparation of Toner n2

The procedure for preparing the toner a1 in Example 1 is repeated except that the monomer composition for the acrylic resin particles B1 is changed so that resulting acrylic resin particles N2 have a T½ of 182.5° C. Thus, a toner n2 is prepared.

Comparative Example 15

Preparation of Toner o2

The procedure for preparing the toner a1 in Example 1 is repeated except that the monomer composition for the acrylic resin particles B1 is changed so that resulting acrylic resin particles O2 have a Tg of 58.9° C. Thus, a toner o2 is prepared.

Comparative Example 16

Preparation of Toner p2

The procedure for preparing the toner a1 in Example 1 is repeated except that the monomer composition for the acrylic resin particles B1 is changed so that resulting acrylic resin particles P2 have a Tg of 91.4° C. Thus, a toner q2 is prepared.

Comparative Example 17

Preparation of Toner q2

The procedure for preparing the toner a1 in Example 1 is repeated except that the monomer composition for the acrylic resin particles B1 is changed so that resulting acrylic resin particles Q2 have a weight average molecular weight (Mw) of 28,000. Thus, a toner q2 is prepared.

Comparative Example 18

Preparation of Toner r2

The procedure for preparing the toner a1 in Example 1 is repeated except that the monomer composition for the acrylic resin particles B1 is changed so that resulting acrylic resin particles R2 have a weight average molecular weight (Mw) of 510,000. Thus, a toner r2 is prepared.

Comparative Example 19

Preparation of Toner s2

The procedure for preparing the toner a1 in Example 1 is repeated except that a low-Tg polyester resin and high-Mw acrylic resin particles are used in combination. Thus, a toner s2 is prepared.

Comparative Example 20

Preparation of Toner t2

The procedure for preparing the toner a1 in Example 1 is repeated except that a high-Tg polyester resin and low-Tg acrylic resin particles are used in combination. Thus, a toner t2 is prepared.

Comparative Example 21

Preparation of Toner u2

The procedure for preparing the toner a1 in Example 1 is repeated except that a low-Tg polyester resin and high-Mw styrene-acrylic resin particles are used in combination. Thus, a toner u2 is prepared.

Comparative Example 22

Preparation of Toner v2

The procedure for preparing the toner a1 in Example 1 is repeated except that the acrylic resin particles B1 are not used. Thus, a toner v2 is prepared.

Comparative Example 23

Preparation of Toner w2

The procedure for preparing the toner a1 in Example 1 is repeated except that the styrene-acrylic resin particles A1 are not used. Thus, a toner w2 is prepared.

Properties and evaluation results of Examples 1-18 and Comparative Examples 1-23 are shown in Tables 2-1 and 2-2.

Preparation of Carrier

A covering layer liquid is prepared by dispersing 21.0 parts of an acrylic resin solution (having a solid content of 50%), 6.4 parts of a guanamine solution (having a solid content of 70%), 7.6 parts of alumina particles (having an average particle diameter of 0.3 μm and a specific resistivity of $10^{14}$ Ω·cm), 65.0 parts of a silicone resin solution (SR2410 from Dow Corning Toray Co., Ltd, having a solid content of 23%), 1.0 part of an aminosilane (SH6020 from Dow Corning Toray Co., Ltd, having a solid content of 100%), 60 parts of toluene, and 60 parts of butyl cellosolve, for 10 minutes using a HOMOMIXER.

The covering layer liquid is applied to the surfaces of calcined ferrite particles ($(MgO)_{1.8}(MnO)_{49.5}(Fe_2O_3)_{48.0}$, having an average particle diameter of 25 μm) using a SPIRA COTA (from Okada Seiko Co., Ltd.), followed by drying, so that a covering layer having a thickness of 0.15 μm is formed thereon. The ferrite particles having the covering layer are burnt in an electric furnace for 1 hour at 150° C. The ferrite particles are then pulverized with a sieve having openings of 106 μm. Thus, a carrier is prepared. The average thickness of the covering layer is determined by observing a cross-section of the carrier particles using a transmission electron microscope (TEM). The carrier has a weight average particle diameter of 35 μm.

Preparation of Two-Component Developers

Each of the above-prepared toners in an amount of 7 parts and the carrier in an amount of 100 parts are uniformly mixed by a TURBULA MIXER to prepare each two-component developer.

Toner Evaluations

Formation of Shell Layers

Each of the toners is embedded in an epoxy resin and left over night. The cured block is cut into ultrathin sections with an ultra microtome. The ultrathin sections are observed with a transmission electron microscope (TEM) to determine whether shell layers of resin particles are formed on the surfaces of toner particles or not. Formation of shell layers is graded as follows.

A: Uniform shell layers of resin particles are formed.

B: Aggregations of resin particles are observed.

C: Shell layer is not formed.

Low-Temperature Fixability

An image forming apparatus Imagio Neo C600 Pro (from Ricoh Co., Ltd.) is modified so that the temperature and linear speed of the fixing part are variable. Each of the toners is set in the apparatus and solid images having a toner content of 0.85±0.1 mg/cm$^2$ are formed on sheets of a thick paper <135> (from Ricoh Co., Ltd.) while varying the temperature of the fixing part. The minimum fixable temperature is a temperature below which the residual rate of image density of a toner image falls below 70% after the toner image is rubbed with a pad, and is graded into the following three ranks.

A: less than 90° C.

B: not less than 90° C. and less than 105° C.

C: not less than 105° C.

Heat-Resistant Storage Stability

Each of the toner is left for 2 weeks at a temperature of 40° C. and a humidity of 70%. Thereafter, the toner is sieved with a 75 mesh while applying a predetermined vibration thereto. Heat-resistant storage stability is evaluated by the amount of toner particles remaining on the sieve and graded as follows.

A: less than 0.5 mg

B: not less than 0.5 mg and less than 1.0 mg

C: not less than 1.0 mg

TABLE 2-1

| | Resins | | Tfb | T½ | T½ − Tfb | Tg | Mw | Formation of Shell Layers | Low-temperature Fixability | Heat-resistant Storage Stability |
|---|---|---|---|---|---|---|---|---|---|---|
| Ex. 1 | Polyester: a1 | Ref | 64.1 | 73.6 | 9.5 | 48.0 | 5,500 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |
| Ex. 2 | Polyester: b1 | T½↓ | 42.6 | 50.1 | 7.5 | 44.0 | 4,200 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |
| Ex. 3 | Polyester: c1 | T½↑ | 69.0 | 79.8 | 10.8 | 49.2 | 7,300 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |
| Ex. 4 | Polyester: d1 | Tg↓ | 45.8 | 50.3 | 4.5 | 20.1 | 16,000 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |
| Ex. 5 | Polyester: e1 | Tg↑ | 64.9 | 78.6 | 13.7 | 59.9 | 4,900 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |
| Ex. 6 | Polyester: f1 | Mw↓ | 64.1 | 72.8 | 8.7 | 48.0 | 3,000 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |

TABLE 2-1-continued

| | Resins | | Tfb | T½ | T½ – Tfb | Tg | Mw | Formation of Shell Layers | Low-temperature Fixability | Heat-resistant Storage Stability |
|---|---|---|---|---|---|---|---|---|---|---|
| Ex. 7 | Polyester: g1 | Mw↑ | 66.0 | 79.9 | 13.9 | 47.7 | 20,000 | A | A | A |
| | St/Ac: A1 | Ref | 136.4 | 174.0 | 37.6 | 62.9 | 420,000 | | | |
| | Ac: B1 | Ref | 122.2 | 150.1 | 27.9 | 79.8 | 31,000 | | | |
| Ex. 8 | Polyester: a1 | Ref | 64.1 | 73.6 | 9.5 | 48.0 | 5,500 | A | A | A |
| | St/Ac: H1 | T½↓ | 122.6 | 142.6 | 20.0 | 48.0 | 46,000 | | | |
| | Ac: B1 | Ref | 122.2 | 150.1 | 27.9 | 79.8 | 31,000 | | | |
| Ex. 9 | Polyester: a1 | Ref | 64.1 | 73.6 | 9.5 | 48.0 | 5,500 | A | A | A |
| | St/Ac: I1 | T½↑ | 164.4 | 187.3 | 22.9 | 64.1 | 460,000 | | | |
| | Ac: B1 | Ref | 122.2 | 150.1 | 27.9 | 79.8 | 31,000 | | | |
| Ex. 10 | Polyester: a1 | Ref | 64.1 | 73.6 | 9.5 | 48.0 | 5,500 | A | A | A |
| | St/Ac: J1 | Tg↓ | 115.2 | 137.7 | 22.5 | 45.0 | 150,000 | | | |
| | Ac: B1 | Ref | 122.2 | 150.1 | 27.9 | 79.8 | 31,000 | | | |
| Ex. 11 | Polyester: a1 | Ref | 64.1 | 73.6 | 9.5 | 48.0 | 5,500 | A | A | A |
| | St/Ac: K1 | Tg↑ | 164.4 | 187.3 | 22.9 | 64.9 | 480,000 | | | |
| | Ac: B1 | Ref | 122.2 | 150.1 | 27.9 | 79.8 | 31,000 | | | |
| Ex. 12 | Polyester: a1 | Ref | 64.1 | 73.6 | 9.5 | 48.0 | 5,500 | A | A | A |
| | St/Ac: L1 | Mw↓ | 136.4 | 158.8 | 22.4 | 61.8 | 40,000 | | | |
| | Ac: B1 | Ref | 122.2 | 150.1 | 27.9 | 79.8 | 31,000 | | | |
| Ex. 13 | Polyester: a1 | Ref | 64.1 | 73.6 | 9.5 | 48.0 | 5,500 | A | A | A |
| | St/Ac: M1 | Mw↑ | 164.4 | 187.9 | 23.5 | 65.1 | 500,000 | | | |
| | Ac: B1 | Ref | 122.2 | 150.1 | 27.9 | 79.8 | 31,000 | | | |
| Ex. 14 | Polyester: a1 | Ref | 64.1 | 73.6 | 9.5 | 48.0 | 5,500 | A | A | A |
| | St/Ac: A1 | Ref | 136.4 | 174.0 | 37.6 | 62.9 | 420,000 | | | |
| | Ac: N1 | T½↓ | 99.4 | 130.2 | 30.8 | 78.6 | 120,000 | | | |
| Ex. 15 | Polyester: a1 | Ref | 64.1 | 73.6 | 9.5 | 48.0 | 5,500 | A | A | A |
| | St/Ac: A1 | Ref | 136.4 | 174.0 | 37.6 | 62.9 | 420,000 | | | |
| | Ac: O1 | T½↑ | 151.1 | 179.7 | 28.6 | 89.7 | 32,000 | | | |
| Ex. 16 | Polyester: a1 | Ref | 64.1 | 73.6 | 9.5 | 48.0 | 5,500 | A | A | A |
| | St/Ac: A1 | Ref | 136.4 | 174.0 | 37.6 | 62.9 | 420,000 | | | |
| | Ac: P1 | Tg↓ | 107.2 | 130.7 | 23.5 | 60.1 | 32,000 | | | |
| Ex. 17 | Polyester: a1 | Ref | 64.1 | 73.6 | 9.5 | 48.0 | 5,500 | A | A | A |
| | St/Ac: Al | Ref | 136.4 | 174.0 | 37.6 | 62.9 | 420,000 | | | |
| | Ac: Q1 | Tg↑ | 129.2 | 158.1 | 28.9 | 90.0 | 35,000 | | | |
| Ex. 18 | Polyester: a1 | Ref | 64.1 | 73.6 | 9.5 | 48.0 | 5,500 | A | A | A |
| | St/Ac: A1 | Ref | 136.4 | 174.0 | 37.6 | 62.9 | 420,000 | | | |
| | Ac: R1 | Mw↓ | 122.2 | 148.4 | 26.2 | 79.5 | 30,000 | | | |

TABLE 2-2

| | Resins | | Tfb | T½ | T½ – Tfb | Tg | Mw | Formation of St/Ac Layer | Formation of Ac Layer | Low-temperature Fixability | Heat-resistant Storage Stability |
|---|---|---|---|---|---|---|---|---|---|---|---|
| Comp. | Polyester: a2 | T½↓ | 45.5 | 48.4 | 2.9 | 41.8 | 18,000 | B | B | A | C |
| Ex. 1 | St/Ac: A2 | Ref | 136.4 | 174.0 | 37.6 | 62.9 | 420,000 | | | | |
| | Ac: B2 | Ref | 122.2 | 150.1 | 27.9 | 79.8 | 31,000 | | | | |
| Comp. | Polyester: b2 | T½↑ | 66.9 | 81.8 | 14.9 | 57.3 | 18,000 | A | C | C | C |
| Ex. 2 | St/Ac: A2 | Ref | 136.4 | 174.0 | 37.6 | 62.9 | 420,000 | | | | |
| | Ac: B2 | Ref | 122.2 | 150.1 | 27.9 | 79.8 | 31,000 | | | | |
| Comp. | Polyester: c2 | Tg↓ | 35.8 | 50.3 | 14.5 | 20.1 | 20,000 | A | C | A | C |
| Ex. 3 | St/Ac: A2 | Ref | 136.4 | 174.0 | 37.6 | 62.9 | 420,000 | | | | |
| | Ac: B2 | Ref | 122.2 | 150.1 | 27.9 | 79.8 | 31,000 | | | | |
| Comp. | Polyester: d2 | Tg↑ | 64.2 | 78.8 | 14.6 | 60.3 | 5,000 | A | C | C | C |
| Ex. 4 | St/Ac: A2 | Ref | 136.4 | 174.0 | 37.6 | 62.9 | 420,000 | | | | |
| | Ac: B2 | Ref | 122.2 | 150.1 | 27.9 | 79.8 | 31,000 | | | | |
| Comp. | Polyester: e2 | Mw↓ | 54.2 | 57.3 | 3.1 | 47.9 | 2,900 | B | B | A | C |
| Ex. 5 | St/Ac: A2 | Ref | 136.4 | 174.0 | 37.6 | 62.9 | 420,000 | | | | |
| | Ac: B2 | Ref | 122.2 | 150.1 | 27.9 | 79.8 | 31,000 | | | | |
| Comp. | Polyester: f2 | Mw↑ | 65.9 | 81.8 | 15.9 | 47.4 | 22,000 | A | C | C | C |
| Ex. 6 | St/Ac: A2 | Ref | 136.4 | 174.0 | 37.6 | 62.9 | 420,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | C | A | A | C |
| Ex. 7 | St/Ac: G2 | T½↓ | 121.5 | 138.5 | 17.0 | 47.9 | 46,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | A | A | C | A |
| Ex. 8 | St/Ac: H2 | T½↑ | 140.8 | 190.6 | 49.8 | 64.4 | 460,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | C | A | A | C |
| Ex. 9 | St/Ac: I2 | Tg↓ | 88.9 | 106.8 | 17.9 | 44.0 | 140,000 | | | | |
| | Ac: B2 | Ref | 122.2 | 150.1 | 27.9 | 79.8 | 31,000 | | | | |

TABLE 2-2-continued

| | Resins | | Tfb | T½ | T½ − Tfb | Tg | Mw | Formation of St/Ac Layer | Formation of Ac Layer | Low-temperature Fixability | Heat-resistant Storage Stability |
|---|---|---|---|---|---|---|---|---|---|---|---|
| Comp. | Polyester: a1 | Ref | 64.1 | 73.6 | 9.5 | 48.0 | 5,500 | A | A | C | A |
| Ex. 10 | St/Ac: J2 | Tg↑ | 142.8 | 191.2 | 48.4 | 66.4 | 480,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | C | A | A | C |
| Ex. 11 | St/Ac: K2 | Mw↓ | 98.4 | 117.0 | 18.6 | 60.2 | 38,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | A | A | C | A |
| Ex. 12 | St/Ac: L2 | Mw↑ | 142.4 | 190.1 | 47.7 | 56.3 | 520,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | A | C | A | C |
| Ex. 13 | St/Ac: A2 | Ref | 136.4 | 174.0 | 37.6 | 62.9 | 420,000 | | | | |
| | Ac: M2 | T½↓ | 109.7 | 128.6 | 18.9 | 78.0 | 30,000 | | | | |
| Comp. | Polyester: a1 | Ref | 64.1 | 73.6 | 9.5 | 48.0 | 5,500 | A | A | C | A |
| Ex. 14 | St/Ac: A2 | Ref | 136.4 | 174.0 | 37.6 | 62.9 | 420,000 | | | | |
| | Ac: N2 | T½↑ | 133.9 | 182.5 | 48.6 | 89.6 | 115,000 | | | | |
| Comp. | Polyester: a1 | Ref | 64.1 | 73.6 | 9.5 | 48.0 | 5,500 | A | B | A | C |
| Ex. 15 | St/Ac: A2 | Ref | 136.4 | 174.0 | 37.6 | 62.9 | 420,000 | | | | |
| | Ac: O2 | Tg↓ | 110.2 | 128.7 | 18.5 | 58.9 | 80,000 | | | | |
| Comp. | Polyester: a1 | Ref | 64.1 | 73.6 | 9.5 | 48.0 | 5,500 | A | A | C | A |
| Ex. 16 | St/Ac: A2 | Ref | 136.4 | 174.0 | 37.6 | 62.9 | 420,000 | | | | |
| | Ac: P2 | Tg↑ | 135.3 | 184.2 | 48.9 | 91.4 | 80,000 | | | | |
| Comp. | Polyester: a1 | Ref | 64.1 | 73.6 | 9.5 | 48.0 | 5,500 | A | C | A | C |
| Ex. 17 | St/Ac: A2 | Ref | 136.4 | 174.0 | 37.6 | 62.9 | 420,000 | | | | |
| | Ac: Q2 | Mw↓ | 85.5 | 104.2 | 18.7 | 77.7 | 28,000 | | | | |
| Comp. | Polyester: a1 | Ref | 64.1 | 73.6 | 9.5 | 48.0 | 5,500 | A | A | C | A |
| Ex. 18 | St/Ac: A2 | Ref | 136.4 | 174.0 | 37.6 | 62.9 | 420,000 | | | | |
| | Ac: R2 | Mw↑ | 140.1 | 188.4 | 48.3 | 65.5 | 510,000 | | | | |
| Comp. | Polyester: s2 | Tg↓ | 45.8 | 50.3 | 4.5 | 20.1 | 16,000 | B | B | B | C |
| Ex. 19 | St/Ac: A2 | Ref | 136.4 | 174.0 | 37.6 | 62.9 | 420,000 | | | | |
| | Ac: R2 | Mw↑ | 140.1 | 188.4 | 48.3 | 65.5 | 510,000 | | | | |
| Comp. | Polyester: t2 | Tg↑ | 65.1 | 78.8 | 13.7 | 60.3 | 5,000 | A | C | C | C |
| Ex. 20 | St/Ac: A2 | Ref | 136.4 | 174.0 | 37.6 | 62.9 | 420,000 | | | | |
| | Ac: T2 | Tg↓ | 105.8 | 128.7 | 22.9 | 58.9 | 31,000 | | | | |
| Comp. | Polyester: u2 | Tg↓ | 45.8 | 50.3 | 4.5 | 20.1 | 16,000 | A | B | C | C |
| Ex. 21 | St/Ac: U2 | Mw↑ | 142.4 | 188.1 | 45.7 | 56.3 | 520,000 | | | | |
| | Ac: B2 | Ref | 122.2 | 150.1 | 27.9 | 79.8 | 31,000 | | | | |
| Comp. | Polyester: a1 | Ref | 64.1 | 73.6 | 9.5 | 48.0 | 5,500 | A | — | A | C |
| Ex. 22 | St/Ac: A2 | Ref | 136.4 | 174.0 | 37.6 | 62.9 | 420,000 | | | | |
| | — | — | — | — | — | — | — | | | | |
| Comp. | Polyester: a1 | Ref | 64.1 | 73.6 | 9.5 | 48.0 | 5,500 | Toner is not produced. | Toner is not produced. | Toner is not produced. | Toner is not produced. |
| Ex. 23 | — | — | — | — | — | — | — | | | | |
| | Ac: B2 | Ref | 122.2 | 150.1 | 27.9 | 79.8 | 31,000 | | | | |

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a core particle, the core particle including a resin P, wherein the resin P is a polyester resin having a weight average molecular weight of 3,000 to 20,000;

an inner shell layer covering the core, the inner shell layer including fine particles of a resin A; and an outer shell layer covering the inner shell layer, the outer shell layer including fine particles of a resin B, wherein the toner satisfies the following formulae (1) to (3):

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

wherein T½(P), T½(A), and T½(B) represent ½ method temperatures of the resins P, A, and B, respectively, and Tfb(P), Tfb(A), and Tfb(B) represent flow beginning temperatures of the resins P, A, and B, respectively, and wherein the ½ method temperatures and the flow beginning temperatures are measured by a flowtester while setting a load to 30 kg, a die diameter to 1.0 mm, a die length to 1.0 mm, a heating rate to 3° C./min, and a sample amount to 1.0 g.

2. The toner according to claim 1, wherein T½(P) is within a range of 50 to 80° C. and a glass transition temperature of the resin P is within a range of 20 to 60° C.

3. The toner according to claim 1, wherein T½(A) is within a range of 130 to 180° C. and a glass transition temperature of the resin A is within a range of 60 to 90° C.

4. The toner according to claim 1, wherein T½(B) is within a range of 130 to 190° C. and a glass transition temperature of the resin B is within a range of 45 to 65° C.

5. The toner according to claim 1, wherein the resin A is an acrylic resin having a weight average molecular weight of 30,000 to 500,000.

6. The toner according to claim 1, wherein the resin B is a styrene-acrylic resin having a weight average molecular weight of 40,000 to 500,000.

7. The toner according to claim 5, wherein the acrylic resin is a cross-linked or non-cross-linked resin including an acrylate polymer unit and/or a methacrylate polymer unit.

8. The toner according to claim 6, wherein the styrene-acrylic resin is a cross-linked or non-cross-linked resin including a styrene polymer unit and an acrylate and/or methacrylate polymer unit.

9. The toner according to claim 1, wherein the resins A and B are incompatible with the resin P and swellable in ethyl acetate.

10. A toner, comprising:

a core particle, the core particle including a resin P;

an inner shell layer covering the core, the inner shell layer including fine particles of a resin A, wherein the resin A is an acrylic resin having a weight average molecular weight of 30,000 to 500,000; and an outer shell layer covering the inner shell layer, the outer shell layer including fine particles of a resin B, wherein the toner satisfies the following formulae (1) to (3):

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

wherein T½(P), T½(A), and T½(B) represent ½ method temperatures of the resins P, A, and B, respectively, and Tfb(P), Tfb(A), and Tfb(B) represent flow beginning temperatures of the resins P, A, and B, respectively, and wherein the ½ method temperatures and the flow beginning temperatures are measured by a flowtester while setting a load to 30 kg, a die diameter to 1.0 mm, a die length to 1.0 mm, a heating rate to 3° C./min, and a sample amount to 1.0 g.

11. The toner according to claim 10, wherein T½(P) is within a range of 50 to 80° C. and a glass transition temperature of the resin P is within a range of 20 to 60° C.

12. The toner according to claim 10, wherein T½(A) is within a range of 130 to 180° C. and a glass transition temperature of the resin A is within a range of 60 to 90° C.

13. The toner according to claim 10, wherein T½(B) is within a range of 130 to 190° C. and a glass transition temperature of the resin B is within a range of 45 to 65° C.

14. The toner according to claim 10, wherein the resin B is a styrene-acrylic resin having a weight average molecular weight of 40,000 to 500,000.

15. The toner according to claim 10, wherein the acrylic resin is a cross-linked or non-cross-linked resin including an acrylate polymer unit and/or a methacrylate polymer unit.

16. The toner according to claim 14, wherein the styrene-acrylic resin is a cross-linked or non-cross-linked resin including a styrene polymer unit and an acrylate and/or methacrylate polymer unit.

17. The toner according to claim 10, wherein the resins A and B are incompatible with the resin P and swellable in ethyl acetate.

18. A toner, comprising:

a core particle, the core particle including a resin P;

an inner shell layer covering the core, the inner shell layer including fine particles of a resin A; and an outer shell layer covering the inner shell layer, the outer shell layer including fine particles of a resin B, wherein the resin B is a styrene-acrylic resin having a weight average molecular weight of 40,000 to 500,000, wherein the toner satisfies the following formulae (1) to (3):

$$4.5 \leq T\tfrac{1}{2}(P) - Tfb(P) \leq 14 \quad (1)$$

$$20 \leq T\tfrac{1}{2}(A) - Tfb(A) \leq 40 \quad (2)$$

$$23.5 \leq T\tfrac{1}{2}(B) - Tfb(B) \leq 40 \quad (3)$$

wherein T½(P), T½(A), and T½(B) represent ½ method temperatures of the resins P, A, and B, respectively, and Tfb(P), Tfb(A), and Tfb(B) represent flow beginning temperatures of the resins P, A, and B, respectively, and wherein the ½ method temperatures and the flow beginning temperatures are measured by a flowtester while setting a load to 30 kg, a die diameter to 1.0 mm, a die length to 1.0 mm, a heating rate to 3° C./min, and a sample amount to 1.0 g.

19. The toner according to claim 18, wherein T½(P) is within a range of 50 to 80° C. and a glass transition temperature of the resin P is within a range of 20 to 60° C.

20. The toner according to claim 18, wherein T½(A) is within a range of 130 to 180° C. and a glass transition temperature of the resin A is within a range of 60 to 90° C.

21. The toner according to claim 18, wherein T½(B) is within a range of 130 to 190° C. and a glass transition temperature of the resin B is within a range of 45 to 65° C.

22. The toner according to claim 18, wherein the styrene-acrylic resin is a cross-linked or non-cross-linked resin including a styrene polymer unit and an acrylate and/or methacrylate polymer unit.

23. The toner according to claim 18, wherein the resins A and B are incompatible with the resin P and swellable in ethyl acetate.

* * * * *